US007053739B2

(12) United States Patent
Wakatsuki et al.

(10) Patent No.: US 7,053,739 B2
(45) Date of Patent: May 30, 2006

(54) ELECTRICAL CONTACTING DEVICE AND METHOD OF MAKING THE SAME

(75) Inventors: Noboru Wakatsuki, Ishinomaki (JP); Yu Yonezawa, Miyagi (JP); Yoshio Satoh, Kawasaki (JP); Tadashi Nakatani, Kawasaki (JP); Tsutomu Miyashita, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 10/725,573

(22) Filed: Dec. 3, 2003

(65) Prior Publication Data

US 2004/0155737 A1 Aug. 12, 2004

(30) Foreign Application Priority Data

Dec. 18, 2002 (JP) ..... 2002-367325

(51) Int. Cl.
*H01H 9/30* (2006.01)

(52) U.S. Cl. ..... 335/201; 335/133; 335/156; 335/196; 200/10

(58) Field of Classification Search ..... 335/83, 335/133–135, 156, 196–200, 201; 200/10
See application file for complete search history.

(56) References Cited

U.S. PATENT DOCUMENTS 3,586,809 A * 6/1971 Santi ..... 200/263
2001/0024895 A1* 9/2001 Sakiyama et al. ..... 439/181

FOREIGN PATENT DOCUMENTS

JP 5-054786 3/1993
JP 10-012117 1/1998

OTHER PUBLICATIONS

Yonezawa, Yu, et al., "Measurement of Electric Contact Phenomenon Using $LiNbO_3$ Piezoelectric Actuator", Jpn. J. Appl. Phys. vol. 41, pp. 4760-4765, Jul. 2002.

* cited by examiner

*Primary Examiner*—Ramon M. Barrera
(74) *Attorney, Agent, or Firm*—Staas & Halsey LLP

(57) ABSTRACT

An electrical contacting device includes a plurality of current paths connected in parallel to each other, and a plurality of electrical contact points each having a first contact and a second contact that are mechanically opened and closed. Each current path is provided with a corresponding one of the contact points. For prevention of the occurrence of arc discharge at the contact points, each current path has its electrical characteristics adjusted in order not to allow the passage of the minimum discharge current.

14 Claims, 24 Drawing Sheets

ELECTRICAL CONTACTING DEVICE AND METHOD OF MAKING THE SAME

BACKGROUND OF THE INVENTION

1. Field of the Invention

The present invention relates to a mechanically operable electrical contacting device utilized for producing switches or relays, for example. The present invention also relates to a method of making such an electrical contacting device.

2. Description of the Related Art

Mechanically operable contacting devices, used for e.g. switches and relays, are designed to close and open an electrical circuit by touching two contacts to each other and separating them. Switches or relays incorporating such a contacting device are used in various applications since the current path of a circuit can be completely broken by bringing the contacting device into circuit-open position, in which the paired contacts are spaced apart from each other, with the air (insulator) intervening therebetween. Such reliable switching devices in use are found in information equipment, industrial machines, automobiles and home electric appliances, for example.

FIGS. 19 and 20 shows a conventional electrical contacting device X5 of the mechanically operable type described above. The contacting device X5 consists of a movable unit (first contactor) 71 and a stationary unit (second contactor) 72.

The movable unit 71 includes a conductive blade 73, a contact 74 disposed at one end of the blade 73, and a socket 75 secured to the blade 73. Such an arrangement is sometimes referred to as a "single contact structure", in which a single contact (74) is provided on one conductive blade (73). While the contact 74 is formed of a conductive material, the socket 75 is formed of an insulating material (resin, for example). The conductive blade 73 is, at the other end, electrically and mechanically connected to a lead 76 made of braided copper wires. The lead 76 is connected to a non-illustrated external circuit. A pin 77 extends through the socket 75 so that the movable unit 71 is allowed to pivot about the axis of the pin 77. The pin 77 is fixed to a non-illustrated case. The pivot of the movable unit 71 is effected by a driving mechanism (not shown) provided with a solenoid, for example.

The stationary unit 72 includes a conductive blade 78 and a contact 79 made of a conductive material. The blade 78 is connected to a non-illustrated external circuit. The contact 79 is located on the track of the contact 73 of the pivoting unit 71.

With the above arrangement, the movable unit 71 is caused to pivot toward the stationary unit 72, with a prescribed voltage applied to the electrical contacting device X5. Then, when the contacts 74 and 79 touch each other, as shown in FIG. 20, electric current flows, for example, from the conductive blade 78 to the lead 76 via the contacts 79, 74 and the blade 73. When the movable unit 71 is caused to pivot in the direction spacing away from the stationary unit 72, the contacts 74 and 79 are separated, as shown in FIG. 19, whereby the electrical current stops.

As is known in the technical field of contacting devices, when the current flowing through the closed contacts is greater than a prescribed threshold ("minimum discharge current"), or when the potential difference between the closed contacts is greater than a prescribed threshold ("minimum discharge voltage"), arc discharge will occur between the contacts as they part from each other.

Specifically, suppose that a current greater than the prescribed threshold is flowing through the closed contacts. As these contacts are parting from each other, the contact area between them gradually decreases, whereby the current flowing through the contacts will concentrate. Accordingly, heat is generated at the contacts, and the surface of the contacts begins to melt. While the separation between the contacts is small, a bridge made of molten contact material is formed between the contacts, thereby keeping the contacts electrically connected to each other. The bridge produces a vapor of metal, and arc discharge occurs through the vapor. Then, the arc discharge causes the ambient air to glow. Further, when the contacts are separated by a sufficient distance, the arc discharge will cease.

FIG. 21 is a graph showing how the occurrence probability of arc discharge depends on the current flowing through paired contacts. For this graph, the contacts made of gold were initially held in pressing contact with each other under prescribed pressing force (10 mN, 100 mN and 200 mN). While a constant voltage of 36V was being applied between the contacts, the contacts were brought away from each other. The occurrence probability of arc discharge was plotted. With a 36V-constant voltage source connected to the contacts, the supplied electric current was adjusted by changing the resistance of a resistor connected in series to the contacts. The substantial contact area for the paired contacts may be no greater than several ten $\mu m^2$. The abscissa of the graph represents the current passing through the closed contacts, while the ordinate represents the occurrence probability of arc discharge. Under any one of the pressing forces, the occurrence probability of arc discharge becomes substantially 100% when the passing current is no smaller than 0.6 A. On the other hand, the occurrence probability becomes substantially 0% when the passing current is no greater than 0.1 A. More detailed information relating to this graph can be found in following non-patent document 1:

[Non-Patent Document 1]

Yu Yonezawa and Noboru Wakatsuki, "Japanese Journal of Applied Physics", The Japan Society of Applied Physics, Jul. 2002, Vol. 41, Part 1, No. 7A, p. 4760–4765.

The graph of FIG. 21 shows that the minimum discharge current (minimum arc current) Imin required for causing arc discharge is in a range of 0.1–0.6 A. It is known that the minimum discharge current depends on the kind of material. Likewise, a minimum discharge voltage (minimum arc voltage) Vmin for causing arc discharge can be determined, and it depends on the kind of material. According to a report, the minimum discharge current Imin for contacts made of gold is 0.38 A, and the minimum discharge voltage Vmin is 15V. It should be noted that the actually measured Imin or Vmin is not always constant and may be subject to variation due to the influence from the electrical field in the space between the paired contacts or from the surface condition of the contacts.

When the electrical contacting device X5 is closed, all the current required by a load (non-illustrated, external circuit for which the current is supplied) passes through the contacts 74 and 79. Thus, when the current to be supplied to the load is greater than the minimum discharge current, arc discharge will occur between the contacts 74 and 79 at the time of contact separation. Generally, the current required by the load is often greater than the minimum discharge current of the contacting device X5.

The generation and disconnection of the arc discharge leads to the melting, evaporation and re-solidification of the material of the contacts 74, 79. Consequently, the contact material will be ablated or transformed, and the contact resistance between the contacts 74 and 79 may be varied. Thus, as the arc discharge between the contacts 74 and 79 occurs more frequently, the reliability of the contacting device X5 tends to deteriorate, and the life of the product tends to be shortened. In particular, such reliability deterioration and shortened production life become more serious when the contacting device X5 is used for passing or disconnecting high current.

In the conventional contacting device X5, the contacts 74, 79 include a low-resistance base member made of copper, and a low-resistance and anticorrosive metal coating (e.g. Au, Ag, Pd or Pt) formed over the base member. However, these low-resistance metals have a relatively low melting point. Thus, they tend to melt by the heat resulting from the arc discharge, thereby suffering ablation and transformation. In this regard, use can be made of metals that melt less easily by the heat generated by the arc discharge. However, such metals have relatively high resistance. Thus, it is unpractical to adopt high-melting point metals for producing contacts of the conventional contacting device X5, in which it is essential to achieve a low contact resistance.

For prevention of arc discharge, a spark quencher may be provided on the contacting device X5. A spark quencher may comprise a varistor or diode connected in parallel to the contacts 74, 79. This approach, however, requires for additional elements beside the contacting device X5. Thus, the use of spark quenchers may be unpreferable in light of the device size and production cost.

In the conventional contacting device X5, a proper closed condition may fail to be achieved due to some foreign matter such as dust intervening between the contacts 74 and 79, when the movable unit 71 is caused to pivot for electrical connection. To avoid such an inconvenience, the contacting device X5 may adopt a movable unit 71' as shown in FIG. 22 in place of the single-contact movable unit 71. The movable unit 71', including a twin-structure conductive blade 73', two contacts 74' provided on one end of the respective branches of the blade 73', and a socket 75 fitted on the blade 73', has the so-called "twin-contact structure" whereby a single conductor blade 73' is provided with two contacts 74'. The conductive blade 73' is connected electrically and mechanically to a lead 76. Likewise of the movable unit 71, the movable unit 71' is caused to pivot about a pin 77 secured to a case (not shown).

Electrical contacting devices including such a twin-contact movable unit are disclosed in following patent-documents 1 and 2, for example.

[Patent-Document 1]

Japanese patent laid-open H05-54786

[Patent-Document 2]

Japanese patent laid-open H10-12117

In the contacting device X5 with the twin-contact movable unit 71', foreign matter may intervene between one of the twin contacts 74' and the lower contact 79, but still the other twin contact can come into conduction with the contact 79 if the foreign matter is not too large. As a result, a desired closed-circuit condition is achieved. However, as in the case where the single-contact movable unit 71 is adopted, arc discharge will occur also in the contacting device X5 provided with the twin-contact movable unit 71'.

SUMMARY OF THE INVENTION

The present invention has been proposed under the circumstances described above. It is, therefore, an object of the present invention to provide an electrical contacting device whereby the occurrence of arc discharge at the contacts is properly prevented. Another object of the present invention is to provide a method of making such an advantageous contacting device.

According to a first aspect of the present invention, there is provided an electrical contacting device comprising: a plurality of current paths connected in parallel to each other; and a plurality of electrical contact points each having a first contact and a second contact that are mechanically opened and closed. Each current path is provided with a corresponding one of the contact points, while also having electrical characteristics thereof adjusted to prevent arc discharge from occurring at the contact point.

Preferably, the device of the present invention further comprises a plurality of resistors connected in series to the contact points, respectively (that is, one resistor connected to a corresponding one of the contact points). For each current path, the adjustment of the electrical characteristic is performed by rendering the resistance of the resistor greater than the contact resistance of the contact point.

The electrical circuit corresponding to the above arrangement is shown in FIG. 1. A contact point (or switch) Si (i=1,2, . . . , N) consists of a pair of contacts C1 and C2, and is connected in series to a resistor Rbi. As shown in the figure, any one of individual current paths contains one contact point and one resistor. These individual current paths are connected in parallel to each other between two terminals E1 and E2. Each contact point Si has a contact resistance (Rci) which is smaller than the resistance of the resistor Rbi (Rci<Rbi).

With the circuit of FIG. 1, each of the individual current paths allows the passage of an electrical current which is equal to the applied voltage divided by (Rci+Rbi). Thus, with Rci remaining constant, the current flowing through each current path can be smaller by increasing Rbi. According to the present invention, Rbi is set to a value great enough to render the flowing current smaller than the minimum discharge current determined for the contact point. As a result, arc discharge at the contact point is prevented. For making the switching characteristics stable, ideally, Rci and Rbi should be the same for all the current paths.

As readily seen, a greater amount of current flows through the contacting device as the number of the individual current paths is increased.

Preferably, the contacting device of the present invention may further comprise: a base having a first surface and a second surface opposite to the first surface; a plurality of projections each disposed on the first surface of the base and having an apex; and a flat electrode which faces the first surface of the base and with which the projections come into contact. The above-mentioned first contacts correspond to the apexes of the projections, and the second contacts correspond to portions of the flat electrode with which the apexes of the projections come into contact. The resistors may not necessarily be a separate device but be a resistive region built in the base and the projections.

Preferably, the base and the projections are integrally formed of the same material substrate (for example, a silicon substrate). By micro-machining techniques, it is possible to collectively form a great number of projections (100-100, 000, or more) on the base. The possible range of the contact resistance of the contact points may be 1–100 mΩ, for example.

Preferably, the device of the present invention may further comprise a common electrode formed on the second surface of the base and connected to the resistors. Preferably, the base may be provided with a plurality of flexible structures each of which is disposed at a corresponding one of the contact points for absorbing contact pressing force acting between the first contact and the second contact. Specifically, each flexible structure may comprise a beam having fixed ends. On each beam is provided a corresponding one of the projections. Alternatively, each flexible structure may comprise a cantilever beam provide with a corresponding one of the projections.

Supposing that a maximum voltage applied to the contacting device is Vmax and a minimum discharge current for each of the contact points is Imin, each of the resistors may have a resistance greater than Vmax/Imin, so that each current path allows the passage of a current smaller than the minimum discharge current.

Supposing that a maximum voltage applied to the contacting device is Vmax, a minimum discharge current for each of the contact points is Imin, and a total resistance of the contacting device is Rs, the number of the current paths to be provided in the contacting device of the present invention may be greater than Vmax/(Rs×Imin).

The above-described formulae are derived in the following manner.

It is supposed that the number of the individual current paths connected in parallel to each other is N (>3), each contact point has the same contact resistance Rc, and each resistor connected in series to the relevant one of the contact points has the same resistance Rb. In this case, the total resistance Rs of the contacting device as a whole is represented by:

$$Rs=(Rc+Rb)/N \tag{1}$$

Generally, Rc is as small as about 1–100 mΩ. Thus, when Rb is sufficiently great (Rb>>Rc), the following equation is obtained from the equation (1).

$$Rs=Rb/N \tag{2}$$

Ideally, all the contact points should be opened simultaneously when the contacting device takes the open-circuit position. In reality, however, the contact points are opened at different times, whereby, at the very last stage of the circuit-opening operation, only one of the contact points is to be opened after all the other contact points have been opened. At this last stage, the greatest current will flow through the remaining one contact point. For complete prevention of arc discharge, this maximum electrical current should be smaller than the minimum discharge current.

Reference is now made to FIG. 2 showing a circuit diagram of the actual setting in using the contacting device of the present invention. As illustrated, the power source (DC or AC) supplies a voltage Vin. The impedance on the side of power input is Rin, while the impedance on the side of the load is Rout. Generally, Rin and Rout, which may be over 10 Ω, are much greater than the resistance Rs of the contacting device. When all the contact points are closed, the following current I flows through the device.

$$I=Vin/(Rin+Rout+Rb/N) \tag{3}$$

Since N contacting points are provided, the current Io flowing through each of the individual current paths (hence, each contact point) is represented by the equation below.

$$Io=I/N=Vin/(N\times(Rin+Rout)+Rb) \tag{4}$$

As the contacting device is shifting from the complete closed condition (all the contact points are closed) to the complete open condition (all the contact points are opened), the N contact points are opened independently of each other. At a given moment during the shifting process, n contact points out of N points (1<n<N) are opened, while (N−n) points are closed. In this situation, the current In flowing through each of the (N−n) closed points is represented by the equation below.

$$\begin{aligned} In &= Vin/((N-n)\times(Rin+Rout+Rb/(N-n)) \\ &= Vin/((N-n)(Rin+Rout)+Rb) \end{aligned} \tag{5}$$

Comparison between the equations (4) and (5) clearly shows that Io is smaller than In (Io<In). In increases as the number of the opened contact points increases, until it attains the maximum value when n=N−1, that is, only the last one of the contact points remains closed. The maximum current $I_{N-1}$ is represented by the equation below.

$$I_{N-1}=Vin/(Rin+Rout+Rb) \tag{6}$$

When the maximum voltage applied to the circuit of FIG. 2 is Vmax (which corresponds to the allowable maximum value of the contact voltage in e.g. a catalogue of relays), and the minimum discharge current is Imin (determined by the material used for making the contact point), the following inequality should be satisfied for arc discharge prevention.

$$I_{N-1}=Vmax/(Rin+Rout+Rb)<Imin \tag{7}$$

The equation (6) gives the following inequality (8). Further, in light of the fact that Rin and Rout are factors existing outside of the contacting device, the inequality (9) represents a sufficient condition for the arc discharge prevention.

$$I_{N-1}=Vmax/(Rin+Rout+Rb)<Vmax/Rb \tag{8}$$

$$Vmax/Rb<Imin \tag{9}$$

When the inequality (9) is satisfied, the required prevention of arc discharge is possible regardless of the values Rin and Rout.

From the inequality (9), the following inequality is obtained.

$$Rb>Vmax/Imin \tag{10}$$

Since Rb=N×Rs (see the equation (2)), the following inequality holds.

$$N>Vmax/(Rs\times Imin) \tag{11}$$

This shows how many contact points should be provided for achieving the desired arc discharge prevention.

In a conventional contacting device, the paired contacts at a contact point need to be separated from each other by a relatively long distance for breaking the arc discharge occurring between the two contacts. According to the present invention, it is possible to achieve complete prevention of arc discharge by designing the contacting device in accordance with the inequalities (10) and (11). With this advantageous feature, the separation distance between the paired contacts can be remarkably smaller for the device of the present invention than the conventional device. Further, since only a small amount of current flows through each of the current paths, it is possible to prevent a bridge forming between the contacts due to the heat that would otherwise be generated by the concentration of the current.

By reducing the current flow for each contact point, the induced voltage dI/dt generated in opening and closing the contact points can be reduced. This contributes to the reduction of electromagnetic noise generated by the contact points, and also to the prevention of secondary arc discharge which would occur due to the induced voltage.

According to the present invention, the adjustment of the electrical characteristics for each current path may be performed by adjusting a contact resistance of the contact point so that the contact resistance becomes high enough to prevent discharge current from occurring in each current path.

The above arrangement is represented by a circuit diagram shown in FIG. 3. Each switch Si, consisting of two contacts C1 and C2, has a high contact resistance that does not allow the passage of a discharge current. A discharge current is a current strong enough to generate arc discharge between the paired contacts. Preferably, all the contact resistances of the respective contact points are made the same to enable stable switching operation.

With the above arrangement, there is no need to provide separate resistors connected to the contact points.

Preferably, each of the contact points has a contact resistance greater than Vmax/Imin, where Vmax is the maximum voltage applied to the contacting device, and Imin is the minimum discharge current for each of the contact points.

Referring to FIG. 4, which is the actual circuit built for using the contacting device of FIG. 3, it is supposed that all the contact points have the same contact resistance Rc. Then, the total resistance Rs of the circuit as a whole is:

$$Rs=Rc/N \tag{12}$$

Taking the input impedance Rin and the output impedance Rout into consideration, the current I flowing through the contacting device is represented by the following equation.

$$I=V\text{in}/(R\text{in}+R\text{out}+Rc/N) \tag{13}$$

In the same manner as the inequality (9) is derived from the equation (3), the following inequality (14) is obtained from the above equation (13).

$$V\text{max}/Rc<I\text{min} \tag{14}$$

When this inequality is satisfied, arc discharge is effectively prevented regardless of the impedances Rin and Rout.

The above inequality (14) gives another inequality:

$$Rc>V\text{max}/I\text{min} \tag{15}$$

Further, from the equation (12) and the inequality (15), the following inequality is obtained.

$$N>V\text{max}/(Rs\times I\text{min}) \tag{16}$$

This formula shows how many contact points should be provided in the circuit of FIG. 3 or 4 for attaining the desired arc discharge prevention.

According to the present invention, preferably, at least one of the first contact and the second contact may be formed of one of a metal, oxide and nitride, each of these three substances containing a metallic element selected from a group of tantalum, tungsten, carbon and molybdenum. Further, at least one of the first contact and the second contact may preferably be formed of a material having a melting point no lower than 3000° C.

In the conventional contacting devices, the paired contacts of a contact point are made of a highly conductive metal such as Cu, Au, Ag, Pd and Pt, since it is believed that a low contact resistance is essential for the contact point. According to the present invention, a metal having a high resistance and high melting point can be used as a material for making the paired contacts of a contact point. Such a metal is advantageous to the prevention of ablation and transformation of the material forming the contacts.

Preferably, the contacting device of the present invention may further comprise a stopper for preventing the base and the flat electrode from approaching each other beyond an allowable minimum distance.

Preferably, the base and the projections may be formed of a silicon material which is at least partially doped with impurities for providing the resistors in the base and the projections. The impurities may be P, As or B. The doping can increase or decrease the resistance of the selected region.

According to a second aspect of the present invention, there is provided a method making an electrical contacting device including a fixing portion, a beam extending from the fixing portion and a projection provided on the beam. The method comprises: a preliminary step for preparing a multilayer material substrate including a first layer, a second layer and an intermediate layer disposed between the first layer and the second layer; a first etching step for subjecting the first layer to etching with use of a first mask pattern to form a projection in the first layer; a second etching step for subjecting the first layer to etching until the intermediate layer is partially exposed and a beam is formed in the first layer, the second etching step being performed with use of a second mask pattern covering the projection; and a third etching step for making a space between the second layer and the beam by etching away a portion of the intermediate layer.

Preferably, the method of the present invention may further comprise the steps of: forming a conductive layer on the material substrate from a side of the first layer after the third etching step; forming a third mask pattern on the fixing portion to cover the conductive layer; and forming a wiring pattern on the fixing portion by subjecting the conductive layer to etching with use of the third mask pattern as a mask.

Preferably, the method of the present invention may further comprise two additional steps performed after the first etching step and before the second etching step. Specifically, one of the additional steps is a step for forming a conductive layer on the material substrate from a side of the first layer, while the other of the additional steps is a step for removing the first mask pattern from the first layer.

Preferably, the etching in the first etching step may be isotropic etching.

Preferably, the first layer and the second layer may be formed of a silicon material, while the intermediate layer may be formed of silicon oxide. The silicon material may be single crystal silicon, polysilicon, or one of these materials doped with impurities. Such a silicon material is different in etching characteristics from silicon oxide. Thus, with the above-described multilayer arrangement, it is possible to prevent the intermediate layer from being unduly etched away during the first etching step, and also to prevent the second layer from being unduly etched away during the second etching step.

Other features and advantages of the present invention will become apparent from the detailed description given below with reference to the accompanying drawings.

DETAILED DESCRIPTION OF THE PREFERRED EMBODIMENTS

Preferred embodiments of the present invention will be described below with reference to the accompanying drawings.

Figure 5:
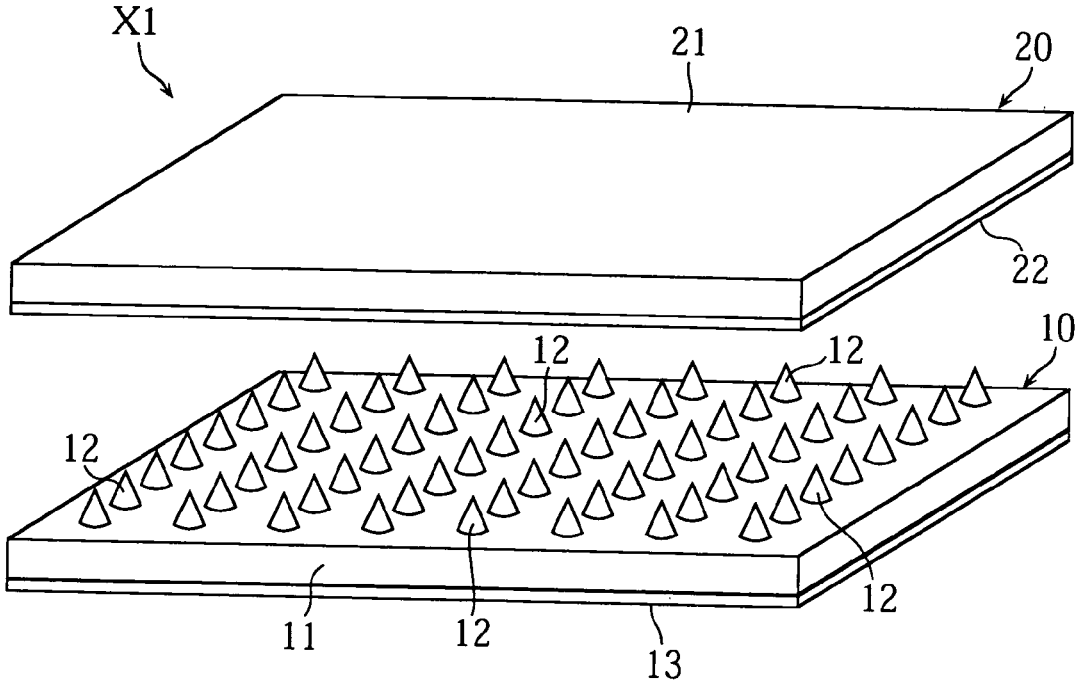
FIG. 5 shows the open position taken by a contacting device of the present invention.
Figure 6:
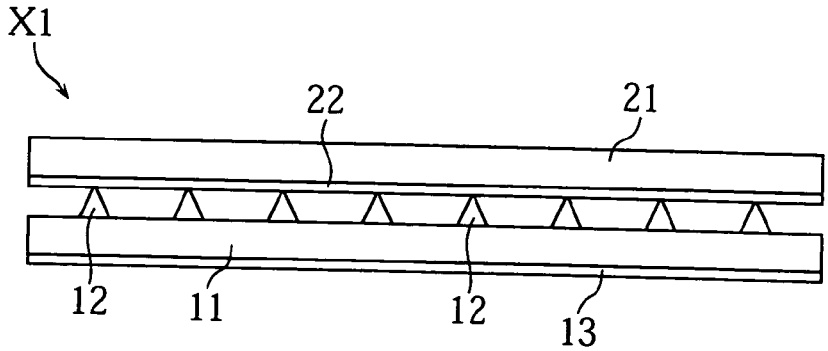
FIG. 6 is a side view showing the contacting device of FIG. 5 taking the closed position.

FIGS. 5 and 6 show an electrical contacting device X1 according to a first embodiment of the present invention. The contacting device X1 includes a first contactor 10 and a second contactor 20. The first contactor 10 has a base 11, a plurality of projections 12, and a flat electrode 13. The base 11 is made of a suitable conductive material, for example, silicon. All the projections 12 are provided on one side of the base 11, each located at a prescribed position. The number of the projections 12 may be in a range of 100–100,000. Each projection 12 is in the form of a cone having a circular or polygonal base. The projections 12 are formed integral with the base 11 and made of the same material as the base 11. Each projection 12 is doped with impurities, as required, and a portion of the base 11 located under the projection 12 is also doped in the thickness direction of the base. Thus, the base 11 and the respective projections 12 are internally formed with resistive regions (resistors) having a prescribed resistance. The impurities to be used may be phosphorus (P), arsenic (As) or boron (B), for example. The height of the projections 12 may be in a range of 1–300 μm, as measured from the upper surface of the base 11. The size relating to the base of the cone (i.e., the diameter for a circular base; the length of a side for a polygonal base) may be in a range of 1–300 μm. Preferably, the height of the projections 12 is generally equal to the size relating to the base of the cone. The surface of each projection 12 may be coated with metal having high melting point and high boiling point. Such a metal may be tungsten (W) or molybdenum (Wo).

The second contactor 20 includes a substrate 21 and a flat, common electrode 22. The substrate 21 is made of silicon, for example. The common electrode 22 is preferably made of a metal having high melting point and high boiling point, such as tungsten or molybdenum. However, if the first contactor 10 is provided with appropriate measures for preventing arc discharge, the common electrode 22 may be made of a metal of low resistance that is selected from a group including copper (Cu), gold (Au), silver (Ag) and platinum (Pt). Alternatively, the common electrode 22 may be made of an alloy containing one (or more) of these low-resistance metals. According to the present invention, the second contactor 20 may not include the substrate 21. In this case, the second contactor 20 as a whole is formed of one of the above-mentioned low-resistance metals, for example.

The first contactor 10 and the second contactor 20 are relatively movable to each other, so that they can take a separate position (open position) shown in FIG. 5 and a contact position (closed position) shown in FIG. 6. In the contact position, all the projections 12 are held in direct contact with the common electrode 22. In the illustrated example, the relative movement of the first and the second contactors 10, 20 is achieved by moving the first contactor 10 toward and away from the second contactor 20 which is held stationary. However, according to the present invention, the relative movement may be achieved by moving the second contactor 20 relative to the first contactor 10 which is held stationary, or by moving both of the first and the second contactors 10 and 20. For means of driving the first contactor 10 and/or the second contactor 20, use may be made of an actuator utilizing an electromagnet, for example. Conventionally, a relay, for example, incorporates such an actuator as driving means for a movable element.

Figure 1:
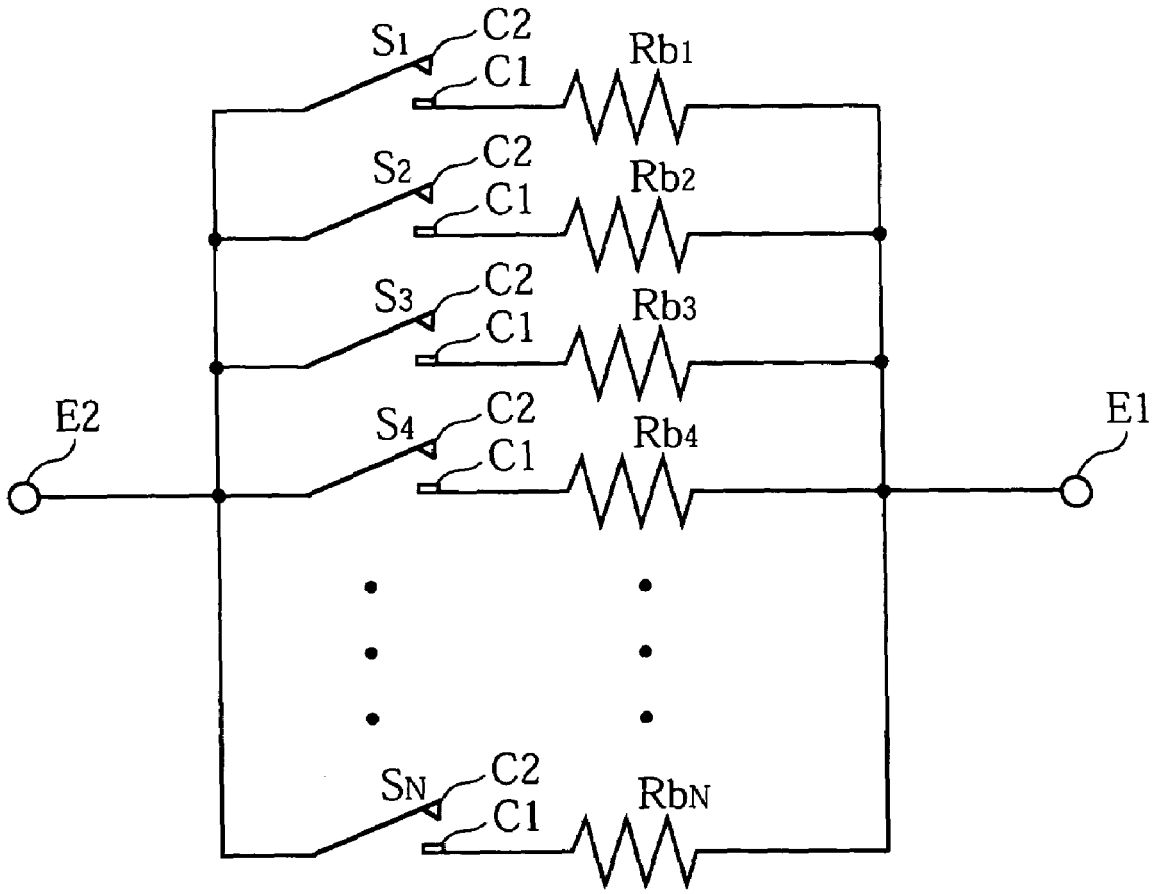
FIG. 1 is a circuit diagram of an electrical contacting device according to the present invention.
Figure 2:
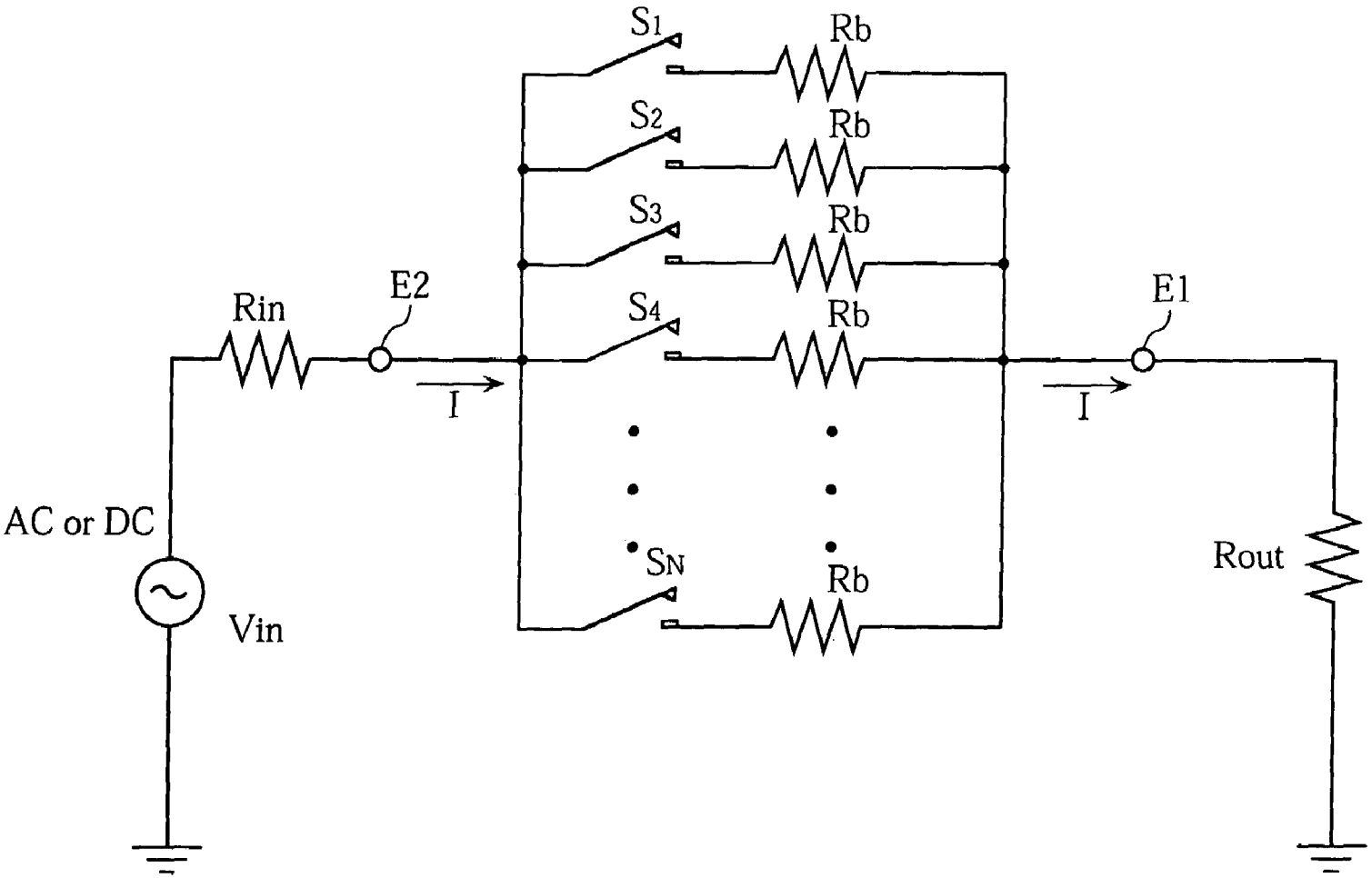
FIG. 2 is a circuit diagram schematically illustrating the actual situation in which the contacting device of FIG. 1 is used.

In the contacting device X1 with the above-described arrangement, a circuit shown in FIG. 1 is built. Specifically, the apexes of the projections 12 of the first contactor 10 correspond to first contact points C1 in the circuit diagram of FIG. 1, while portions of the common electrode 22 with which the projections 12 come into engagement correspond to second contact points C2 in the diagram. The flat electrode 13 corresponds to a terminal E1. The silicon regions extending from the apexes of the projections 12 to the flat electrode 13 correspond to resistors Rbi (i=1,2, . . . , N). Electrically the common electrode 22 also corresponds to a terminal E2. The resistance of each resistor Rbi can be set to a desired value by adjusting the thickness of the base 11 or the size and configuration of the projections 12. The resistance also depends upon the material forming the base 11 and projections 12, or upon the condition of the doping. In the illustrated embodiment, the base 11 and the projections 12 are formed of a silicon material. The resistance adjustment for each resistor Rbi is made so that the resistance lies in a range of 10–100 kΩ, for example. In the contacting device X1, the setting of the respective resistors Rbi and the setting of the number N of contacting points are made so that Inequalities (10) and (11) are satisfied. The minimum discharge current Imin in Inequalities (10) and (11) is defined as a current with which the occurrence probability of arc discharge is 50% (or below), for example. It should be noted that the minimum discharge current Imin may vary in accordance with the applications of the contacting device X1. This scenario regarding the setting of the minimum discharge current Imin also holds for the subsequent embodiments.

The function of the contacting device X1 is as follows. When the first contactor 10, driven by the non-illustrated actuator, comes into the contact position shown in FIG. 6, each of the projections 22 is held in direct contact with the common electrode 22, whereby all the electrical contacting points are closed. At this stage, a current will pass through the contacting device X1 upon application of voltage between the flat electrode 13 and the common electrode 22. Then, when the first contactor 10 is actuated to take the separate position shown in FIG. 5, the projections 12 are spaced away from the common electrode 22, whereby all the electrical contacting points are opened. Accordingly, the current flow through the contacting device X1 is broken.

When the first contactor 10 is separated from the second contactor 20, no arc discharge or only acceptably small amount of arc discharge will occur at the electrical contacting points. This is because the contacting device X1 has a circuit structure shown in FIG. 1, and the settings of resistors Rbi and the number N of the contacting points are made so that Inequalities (10) and (11) are satisfied. The complete prevention or non-complete but practically acceptable prevention of the arc discharge contributes to avoiding ablation and transformation of the materials forming the contacting points of the unit X1. Accordingly, the unit X1 of the present invention lasts a long life and can be used in applications where a highly reliable switching operation is desired.

FIG. 7 show a process of making the first contactor 10. The illustrated process is one example for making the above-described first contactor 10 by utilizing micro-machining techniques. FIG. 7 are partial sectional views showing the first contactor 10 in the making.

Figure 7A:
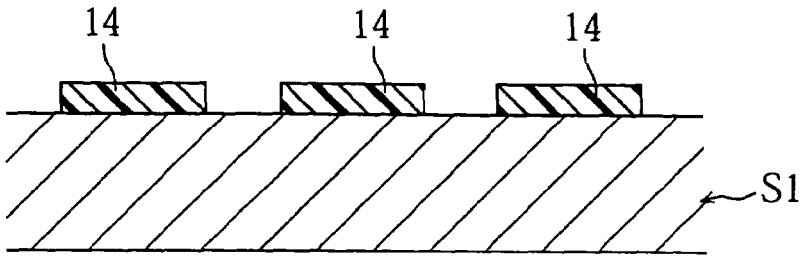
FIGS. 7A–7D illustrate the process of making a first contactor of the contacting device shown in FIGS. 5 and 6.

At the first step for making the first contactor 10, a projection-forming resist pattern 14, as shown in FIG. 7A, is made on a silicon substrate S1. Specifically, a resist layer is formed on the silicon substrate S1 by spin-coating of a liquid photoresist material, and then the desired resist pattern 14 is made by exposure of light and development. The resist pattern 14 includes circular or square masks in accordance with the configuration of the projections to be made. For the photoresist material, use may be made of AZP4210 (available from Clariant Japan) or AZ1500 (available from Clariant Japan), for example. The photoresist patterns to be described later can also be made in the same manner, i.e., by formation of a photoresist layer, light exposure and development.

Figure 7B:
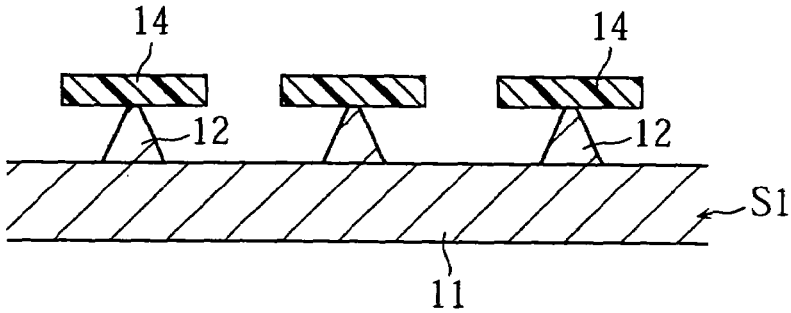
Figure 7C:
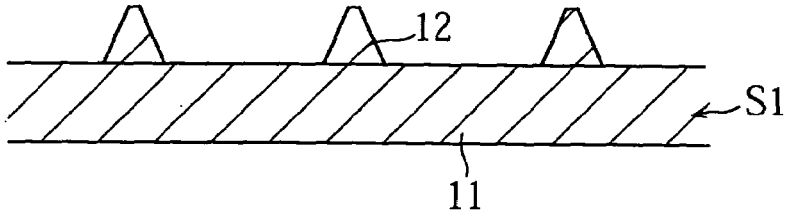

Then, with the resist pattern 14 used as a mask, isotropic etching is performed with respect to the silicon substrate S1 until the desired etching depth is attained. The etching may be reactive ion etching (RIE). Thus, as shown in FIG. 7B, a base 11 and a plurality of projections 12 integral with the base are formed. For clarity of illustration, the boundary between the base 11 and the projections 12 is depicted with a solid line. This holds for the boundary between the base and the projections in the subsequent examples. Then, as shown in FIG. 7C, the resist pattern 14 is removed from the silicon substrate S1. For the parting agent, use may be made of AZ Remover 700 (available from Clariant Japan). The removal of the resist patterns in the subsequent examples can be performed with the use of the same parting agent.

Figure 7D:
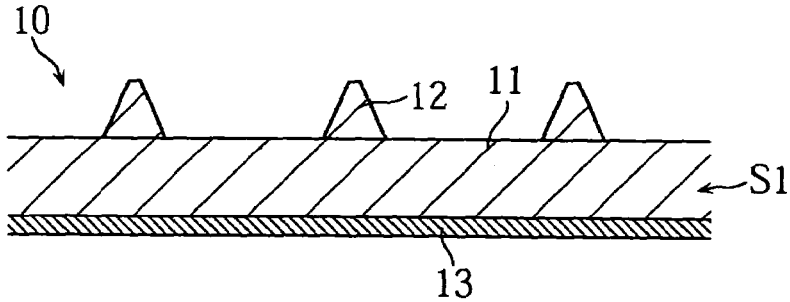

Then, as shown in FIG. 7D, a flat electrode 13 is formed on the lower surface of the silicon substrate S1 that is opposite to the projection-formed surface. The flat electrode 13 may be made by vapor deposition of a suitable metal or provided by attaching a metal plate or metal foil to the substrate.

Through the above process, the first contactor 10 is obtained, which includes the base 11 and the integral projections 12. According to the present invention, the first contactor 10 may have a different structure. For instance, the contactor 10 may include a base 11 made of a low-resistance metal, and separately prepared projections 12 made of a high-melting point and high-resistance metal, the projections 12 being secured to the base 11. In this case, the base 11 is preferably a copper plate, while the projections 12 are preferably made of tungsten or molybdenum.

The second contactor 20 can be prepared by forming a flat, common electrode 22 on a substrate 21 by vapor deposition of a suitable metal. Alternatively, the second contactor 20 may be prepared by attaching a metal plate or metal foil as the common electrode 22 to the substrate 21.

Figure 8:
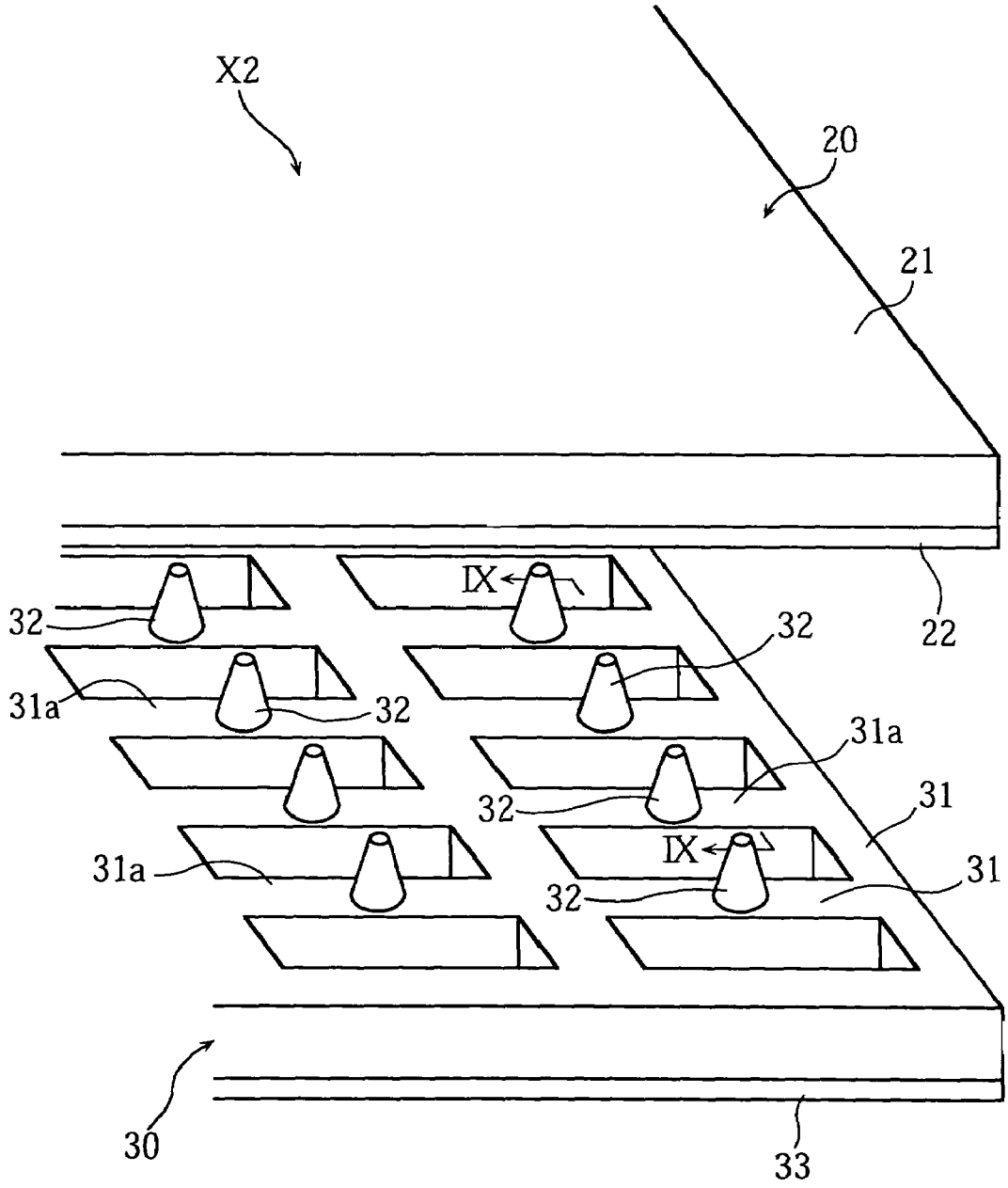
FIG. 8 is a partial perspective view showing a different type of contacting device according to the present invention.

FIG. 8 is a perspective view showing a part of an electrical contacting device X2 according to a second embodiment of the present invention. The contacting device X2 includes a first contactor 30 and a second contactor 20. The first contactor 30 includes a base 31, a plurality of projections 32, and an electrode 33. The base 31, made of e.g. a silicon material, has a plurality of beams 31*a* formed integral with the base. The projections 32 are arranged in a two-dimensional array on one side of the base 31. Each projection 32 is provided on a corresponding one of the beams 31*a*. In the illustrated example, each projection 32 is generally a circular cone, formed integral with the base 31. The projections 32 are made of the same material as the base 31. The surface of each projection 32 may be coated with a metal having a high melting point and a high boiling point. Such a metal are tungsten or molybdenum, for example. The number of projections 32 to be provided and the size thereof are the same as those of the projections 12 of the first embodiment described above. The second contactor 20 of the second embodiment is the same as the second contactor of the first embodiment.

The first contactor 30 and the second contactor 20 are relatively movable to each other, and they can selectively take a separate position (see FIG. 8) and a contact position in which all the projections 32 are held in direct contact with the common electrode 22. The relative movement of the first and the second contactors 30, 20 can be achieved by moving the first contactor 30 with respect to the second contactor 20 rendered stationary. Alternatively, the other relative driving modes as described with the first embodiment may be adopted. Driving means for the first contactor may be the same as that described with the first embodiment.

In the contacting device X2 again, the circuit shown in FIG. 1 is built. Specifically, the apexes of the projections 32 of the first contactor 30 correspond to the first contacting points C1 in FIG. 1, while the portions of the common electrode 22 with which the projections 32 are held in engagement correspond to the second contacting points C2. The electrode 33 corresponds to the terminal E1. The silicon regions extending from the apexes of the projections 32 to the electrode 33 correspond to the resistors Rbi (i=1,2, . . . , N). Electrically the common electrode 22 also corresponds to the terminal E2. As described above in connection to the first embodiment, the resistance of each resistor Rbi can be set to a desired value by adjusting the thickness of the base 31 or the size and configuration of the projections 32. The resistance also depends upon the material forming the base 31 and projections 32, or upon the condition of the doping. Further, in the contacting device X2, the setting of the respective resistors Rbi and the setting of the number N of contacting points are made so that Inequalities (10) and (11) are satisfied.

The function of the contacting device X2 is as follows. When the first contactor 30 is actuated to take the contact position, all the projections 32 are held in direct contact with the common electrode 22, whereby all the contacting points are closed. At this stage, the respective projections 32 are caused to press against the common electrode 22 with substantially the same pressing force. This feature is ascribed to the presence of the beams 31*a*. Specifically, even if the first contactor 30 and the second contactor 20 are oriented slightly askew (i.e., fail to be arranged in parallel), the beams 31*a* can sag to absorb extra pressing force acting between the projections 32 and the common electrode 22 held in mutual contact. As a result, the pressing force between the projections and the electrode is leveled off, whereby a proper contact condition is attained. In such a contact condition, upon application of voltage between the electrode 33 and the common electrode 22, a current will pass through the contacting device X2. Then, when the first contactor 30 is actuated to take the separate position shown in FIG. 8, the respective projections 32 are spaced away from the common electrode 22, thereby rendering all the contacting points open. Thus, the current passing through the unit X2 is broken.

When the first contactor 30 is separated from the second contactor 20, no arc discharge or only acceptably small amount of arc discharge will occur at the electrical contacting points. This is because the contacting device X2 has a circuit structure shown in FIG. 1, and the settings of resistors Rbi and the number N of the contacting points are made so that Inequalities (10) and (11) are satisfied. The complete or acceptable prevention of the arc discharge contributes to prevention of ablation and transformation of the materials forming the contacting points of the unit X2. As a result, the unit X2 of the present invention lasts a long life and can be used in applications where a highly reliable switching operation is desired.

FIG. 9 show a process of making the first contactor 30. The illustrated process is one example for making the first contactor 30 by utilizing micro-machining techniques. FIG. 9 are partial sectional views illustrating the first contactor 30 in the making. The section is taken along the lines IX—IX in FIG. 8.

Figure 9A:
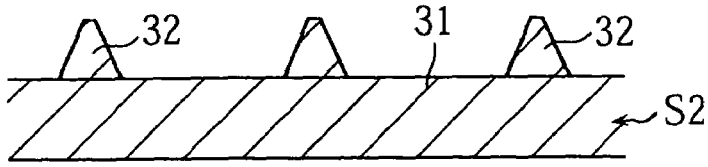
FIGS. 9A–9E illustrate the process of making a first contactor of the contacting device shown in FIG. 8.

To make the first contactor 30, first, a silicon substrate S2 as shown in FIG. 9A is prepared by the same steps as those described with reference to FIGS. 7A–7C of the first embodiment. The substrate S2 includes a base 31 and a plurality of projections 32 formed integral with the base.

Figure 9B:
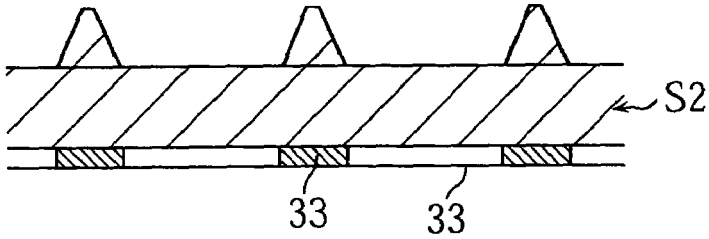

Then, as shown in FIG. 9B, an electrode 33 is formed on the lower surface of the substrate S2 that is opposite to the projection-formed surface. Specifically, the electrode 33 may be made by forming a metal layer on the lower surface of the substrate S1 by vapor deposition of a suitable metal, and then patterning the metal layer into the prescribed configuration.

Figure 9C:
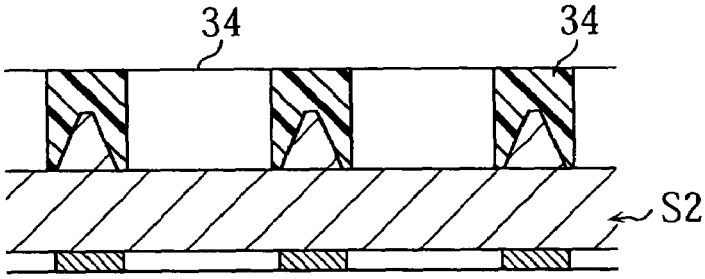

Then, as shown in FIG. 9C, a beam-forming resist pattern 34 is formed on the silicon substrate S2. The resist pattern 34, formed with a plurality of openings, covers portions to be processed into the beams 31*a* and frame-parts integral with the beams.

Figure 9D:
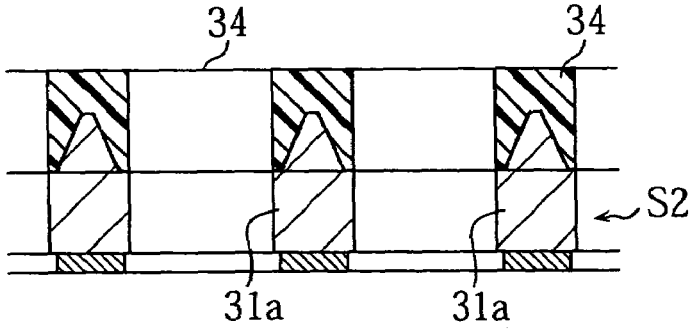

Then, as shown in FIG. 9D, anisotropic etching is performed on the silicon substrate S2 with the resist pattern 34 used as a mask. The anisotropic etching may be Deep-RIE, for example. In accordance with a Deep-RIE technique, or Bosch process, etching and side wall protection are performed alternately. For example, etching with the use of SF6 gas is performed for 8 seconds, whereas the side wall protection with the use of C4F8 gas is performed for 6.5 seconds. The bias applied to the wafer is 23 W, for example. These conditions may hold for the Deep-RIE to be conducted in the subsequent embodiments.

Figure 9E:
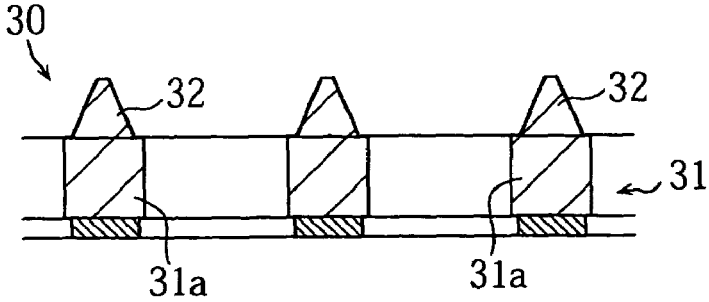

Then, as shown in FIG. 9E, the resist pattern 34 is removed from the silicon substrate S2. As a result, the first contactor 30 is obtained, which includes a beam-integrated base 31 and projections 32 formed integral with the base.

Figure 10:
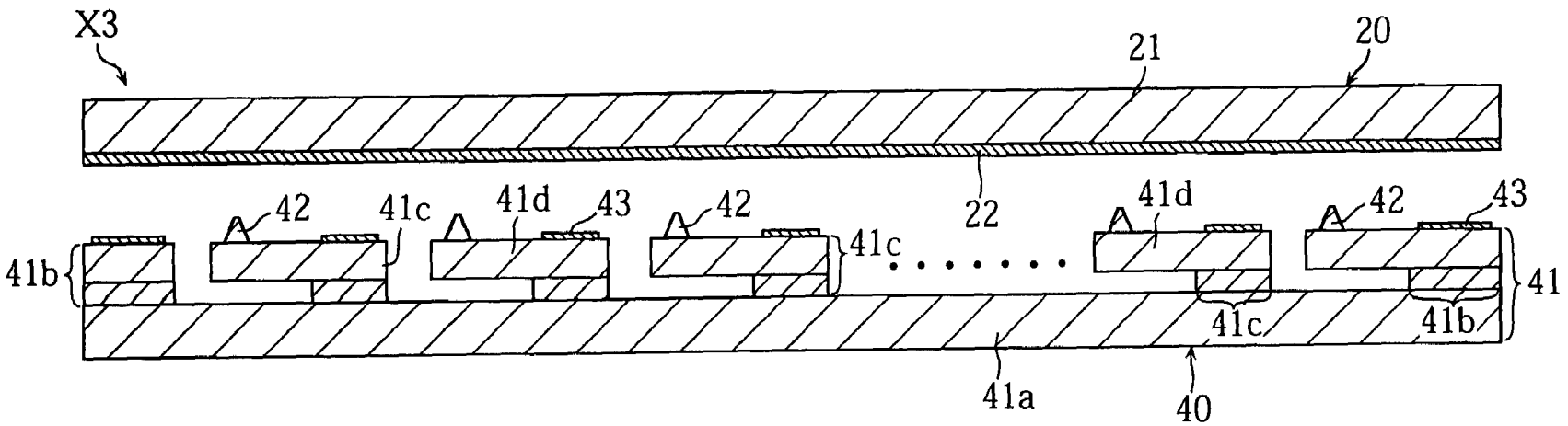
FIG. 10 is a sectional side view showing another type of contacting device according to the present invention.

FIG. 10 is a sectional view showing an electrical contacting device X3 according to a third embodiment of the present invention. The unit X3 includes a first contactor 40 and a second contactor 20. The first contactor 40 includes a base 41, projections 42 and an electrode 43. It should be noted that in FIG. 10, the electrode 43 seems to have a plurality of separate parts, but actually the electrode 43 is a single, continuous element, as seen from FIG. 11.

The base 41 includes a rear portion 41*a*, a frame portion 41*b*, common fixing portions 41*c*, and beam portions 41*d*. As will be described later, these elements are integrally formed from a common material plate by a micro-machining technique. In the illustrated example, the frame portion 41*b* extends continuously along the four sides of the rectangular rear portion 41*a* (see FIG. 11).

Figure 11:
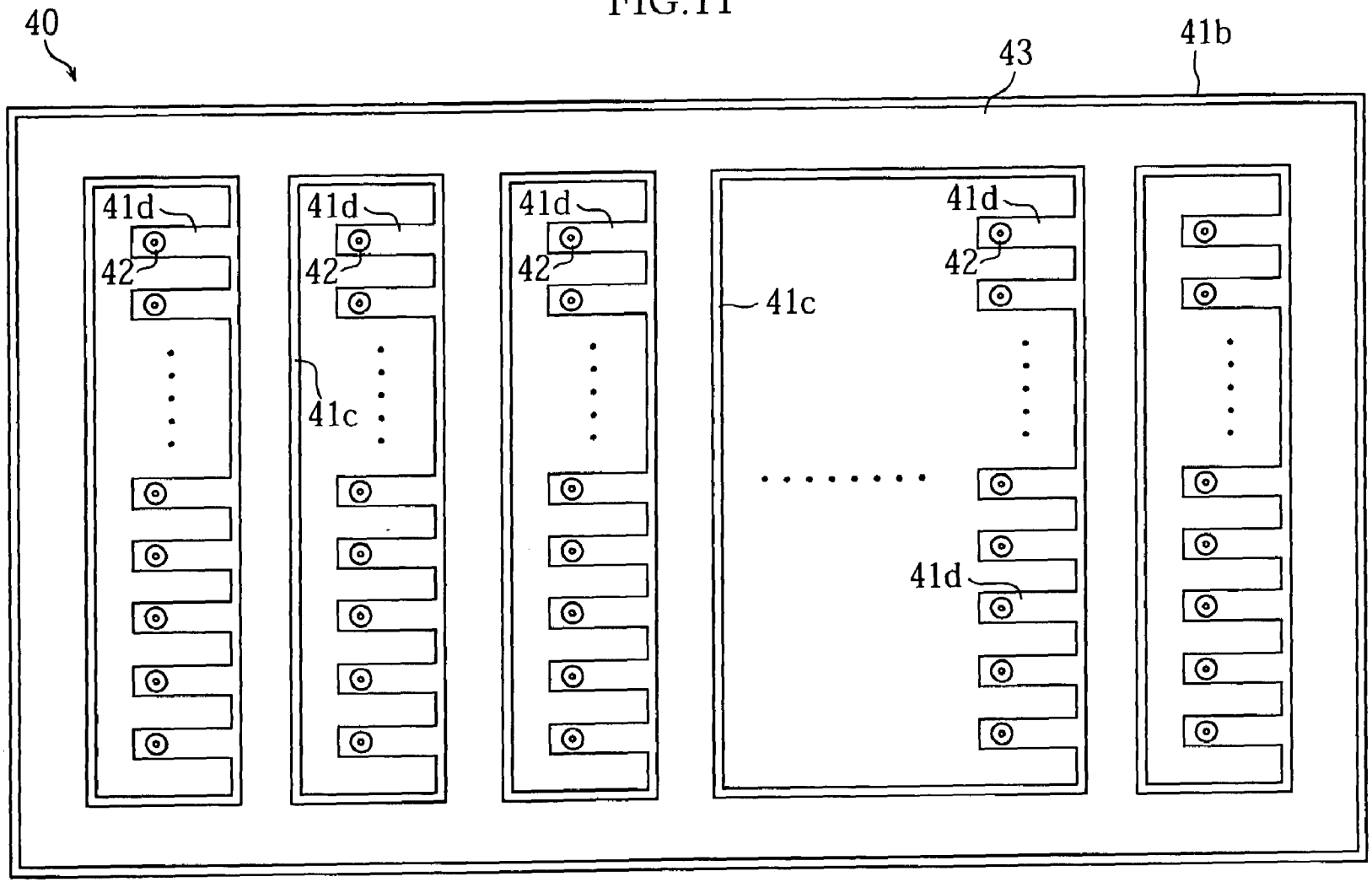
FIG. 11 is a plan view showing the first contactor of the contacting device of FIG. 10.

As shown in FIG. 11, the common fixing portions 41*c* are arranged in parallel with each other on the rear portion 41*a*. Each of the fixing portions 41*c* is integrally connected, at its both ends, to the frame portion 41*b*. As seen from FIGS. 10 and 11, each of the beams 41*d* projects laterally from a corresponding one of the common fixing portions 41*c* in a manner such that the beam 41*d* functions as a cantilever. Referring to FIG. 11, in a region between two immediately adjacent common fixing portions 41*c*, a prescribed number of beams 41*d* extend in parallel from one of the adjacent fixing portions 41*c* toward the other.

As shown in FIG. 11, the projections 42 are arranged in a two-dimensional array. In the illustrated example, each projection 42 is generally a circular cone located on a corresponding one of the beams 41*d*. To provide a prescribed electrical current path for electrically connecting the apex of each projection to the electrode 43, upper parts of the common fixing portions 41*c*, the beams 41*d*, and the projections 42 may be formed of the same conductive material. The electrode 43 is made of a metal (such as Au or Al) which has a lower resistance than the upper part of fixing portions 41*c*, the beams 41*d*, and the projections 42. The electrode 43 is formed on the frame portion 41*b* and the common fixing portions 41*c* to have a prescribed pattern. The surface of each projection 42 may be coated with a metal having a high melting point and a high boiling point. Such a metal is tungsten or molybdenum, for example. The number and size of projections 42 to be provided may be the same as those of the projections 12 of the first embodiment described above.

The first contactor 40 and the second contactor 20 are relatively movable to each other, so that they selectively take a separate position (open position) shown in FIG. 10 and a contact position (closed position) in which all the projections 42 are held in direct contact with the common electrode 22. The relative movement of the first and the second contactors 10, 20 can be achieved by moving the first contactor 40 toward and away from the second contactor 20 which is held stationary. However, according to the present invention, the relative movement may be achieved in the other manners as described in connection to the first embodiment. The actuator for the first contactor 40 may be the same as the one described in connection to the first embodiment.

In the contacting device X3 again, the circuit shown in FIG. 1 is built. Specifically, the apexes of the projections 42 of the first contactor 40 correspond to the first contacting points C1 in FIG. 1, while the portions of the common electrode 22 with which the projections 42 are held in engagement correspond to the second contacting points C2. The electrode 43 corresponds to the terminal E1. The silicon regions extending from the apexes of the projections 42, the beams 41*d* and further to the electrode 43 correspond to the resistors Rbi (i=1,2, . . . , N). Electrically the common electrode 22 also corresponds to the terminal E2. The resistance of each resistor Rbi can be set to a desired value by modifying the material of the region extending from the apex of the projection 42, the beam 41*d* and to the electrode 43, or changing the condition and extent of doping, or adjusting the size and configuration of the beam 41*d* or the projection 42. Further, in the contacting device X3, the setting of the respective resistors Rbi and the setting of the number N of contacting points are made so that Inequalities (10) and (11) are satisfied.

The function of the contacting device X3 is as follows. When the first contactor 40 is actuated to take the contact position, all the projections 42 are held in direct contact with the common electrode 22, whereby all the contacting points are closed. At this stage, the respective projections 42 are caused to press against the common electrode 22 with substantially the same pressing force. This feature is ascribed to the presence of the beams 41*d*. Specifically, even if the first contactor 40 and the second contactor 20 are oriented slightly askew (i.e., fail to be arranged in parallel), the beams 41*d* can sag to absorb extra pressing force acting between the projections 42 and the common electrode 22 held in mutual contact. Since the beams 41*d* have a cantilever structure, they are more flexible than the beams 31*a* of the second embodiment. Thus, the pressing force between the projections and the electrode is leveled off, whereby a proper contact condition is attained. In such a contact condition, upon application of voltage between the electrode 43 and the common electrode 22, a current will pass through the contacting device X3. Then, when the first contactor 40 is actuated to take the separate position shown in FIG. 10, the respective projections 42 are spaced away from the common electrode 22, thereby rendering all the contacting points open. Thus, the current passing through the unit X3 is broken.

When the first contactor 40 is separated from the second contactor 20, no arc discharge or only acceptably small amount of arc discharge will occur at the electrical contacting points. This is because the contacting device X3 has a circuit structure shown in FIG. 1, and the settings of resistors Rbi and the number N of the contacting points are made so that Inequalities (10) and (11) are satisfied. The complete or acceptable prevention of the arc discharge contributes to prevention of ablation and transformation of the materials forming the contacting points of the unit X3. As a result, the unit X3 of the present invention lasts a long life and can be used in applications where a highly reliable switching operation is desired.

FIG. 12 show a process of making the first contactor 40 of the unit X3. The process is one example for making the first contactor 40 by micro-processing techniques. FIG. 12 are partial sectional views showing the first contactor 40 in the making.

Figure 12A:
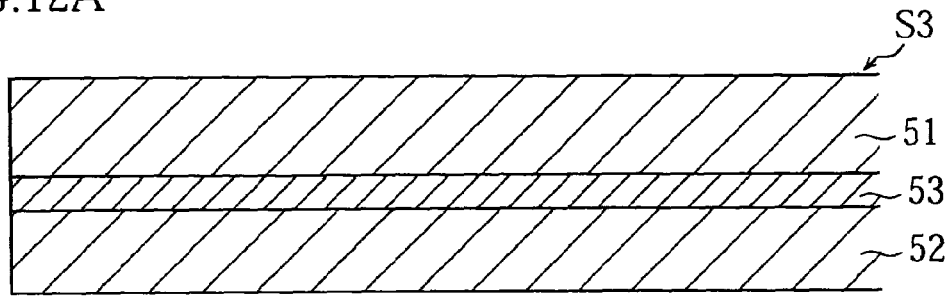
FIGS. 12A–12L illustrate the process of making a first contactor of the contacting device of FIG. 10.

To make the first contactor 40, first, a substrate S3 shown in FIG. 12A is prepared. The substrate S3, which is a silicon-on-insulator (SOI) substrate, has a multilayer structure including a first layer 51, a second layer 52, and a intermediate layer 53 disposed between the first and the second layers. In the illustrated example, the first layer 51 may have a thickness of 20 μm, the second layer 52 may have a thickness of 200 μm, and the intermediate layer 53 may have a thickness of 20 μm. The first layer 51 and the second layer 52 are made of a silicon material doped with n-type impurities such as phosphorus and arsenic, as required, for providing electrical conductivity. For the same purpose, use may be made of boron, for example, which serves as a p-type impurity. It is also possible to use both a n-type impurity and a p-type impurity for the doping, so that the doped part of the silicon material has a greater resistance than the remaining portions. In the illustrated example, the intermediate layer 53 is formed of an insulating substance such as silicon oxide or silicon nitride. With the intermediate layer 53 made of an insulating material, beams 41*d* and projections 42 formed on the substrate S3 are properly insulated from the rear portion 41*a*. According to the present invention, however, the intermediate layer 53 may be formed of a conductive material. In this case, the electrode 43 can be provided on the rear portion 41*a* instead of on the frame-portion 41*b* and the common fixing portions 41*c*.

Figure 12B:
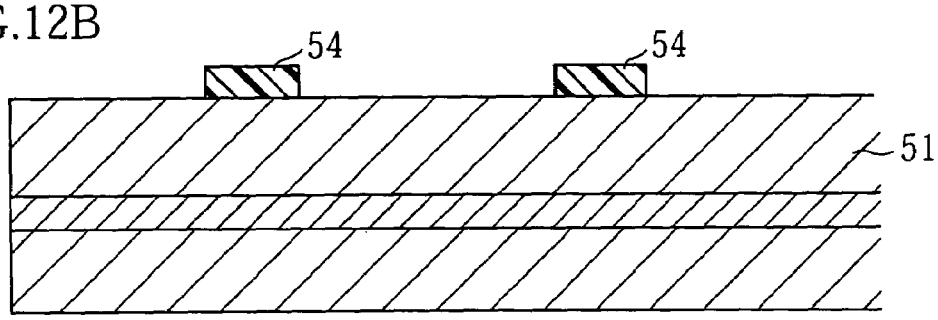

Then, as shown in FIG. 12B, a resist pattern 54 is formed on the first layer 51. The resist pattern 54 includes circular masks corresponding to the configuration of the projections to be made. Preferably, the diameter of each circular mask is about twice the height of the projection 42.

Figure 12C:
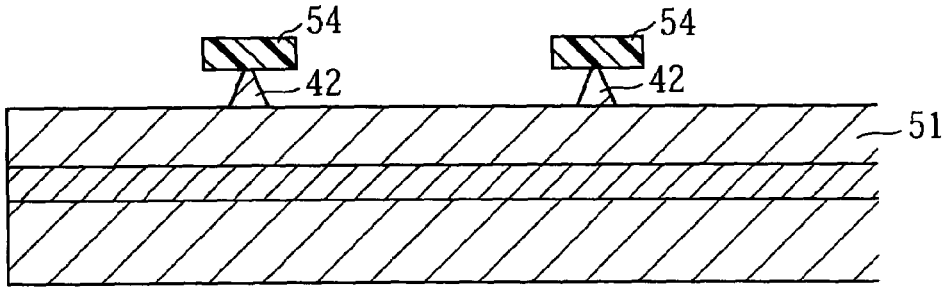
Figure 12D:
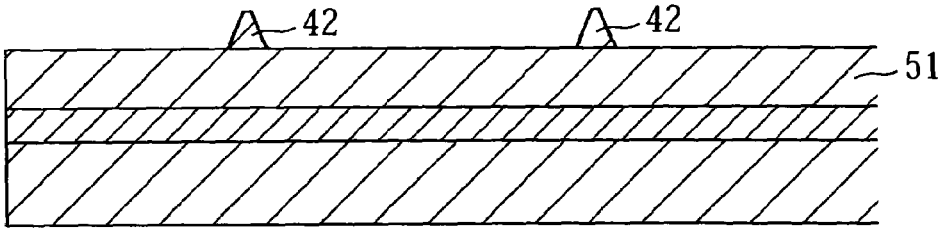

Then, with the resist pattern 54 used as the mask, isotropic etching is performed on the first layer 51 until the desired etching depth is attained. The etching may be reactive ion etching. Thus, as shown in FIG. 12C, a plurality of projections 42 are formed. Thereafter, as shown in FIG. 12D, the resist pattern 54 is removed from the first layer 51.

Figure 12E:
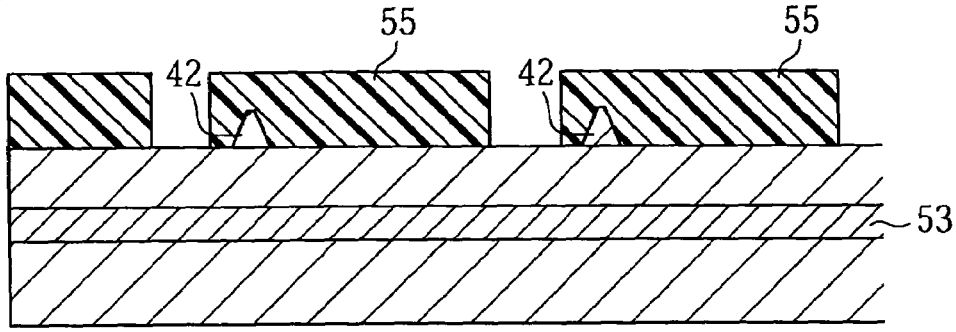

Then, as shown in FIG. 12E, a resist pattern 55 is formed on the first layer 51. The resist pattern 55 encloses the projections 42, while also covering the portions to be processed into the above-mentioned frame-portion 41*b*, the common fixing portions 41*c*, and the beams 41*d*.

Figure 12F:
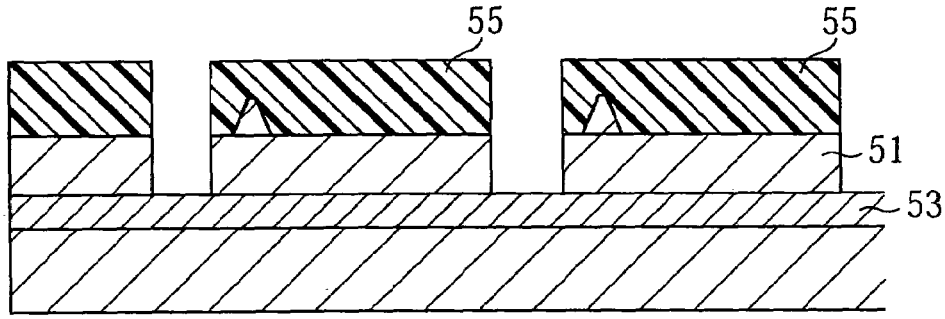

Then, as shown in FIG. 12F, with the resist pattern 55 used as the mask, anisotropic etching is performed on the first layer 51 until the intermediate layer 53 is exposed. As noted above, anisotropic etching may be Deep-RIE, for example.

Figure 12G:
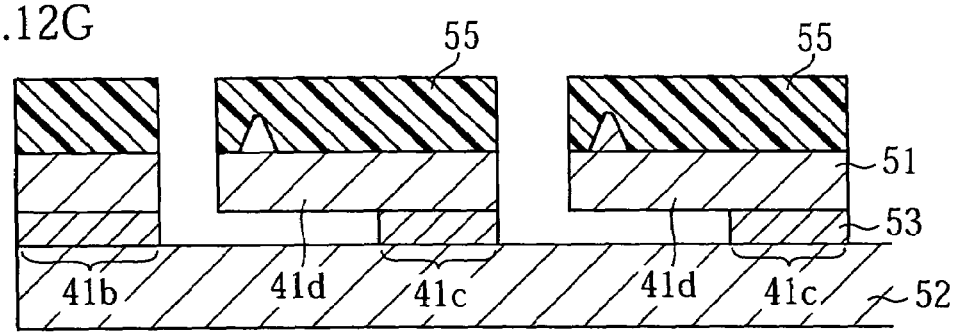
Figure 12H:
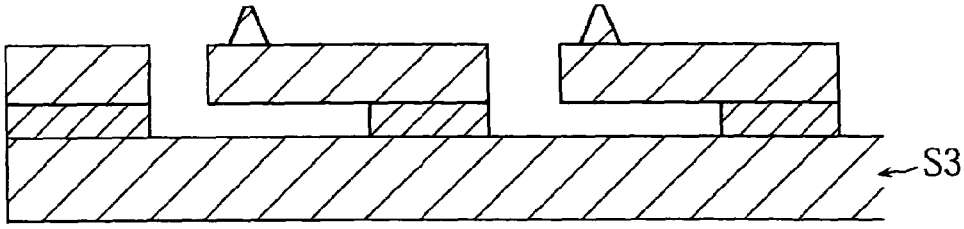

Then, as shown in FIG. 12G, portions of the intermediate layer 53 that are located under the beams 41*d* are removed by wet etching. When the intermediate layer 53 is made of silicon oxide, an appropriate etchant is fluoric acid, for example. As a result of the etching, the desired outline configurations are given to the frame-portion 41*b*, the common fixing portions 41*c*, and the beams 41*d*. Then, as shown in FIG. 12H, the resist pattern 55 is removed from the substrate S3.

Figure 12I:
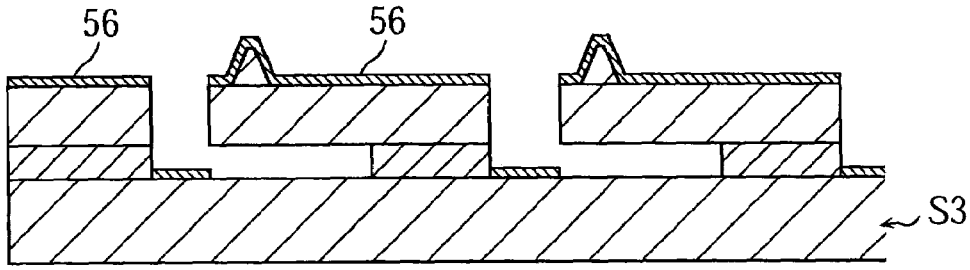
Figure 12J:
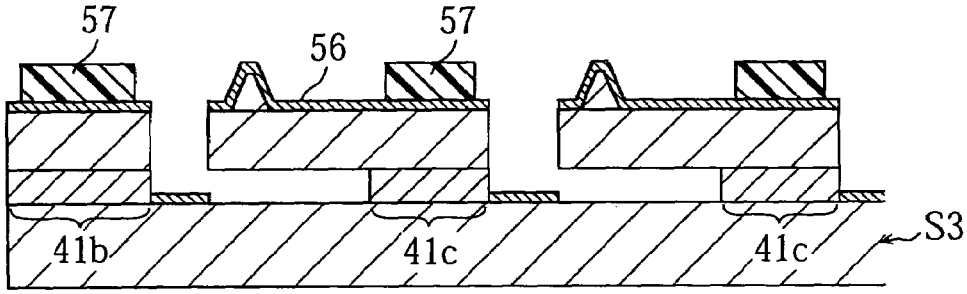
Figure 12K:
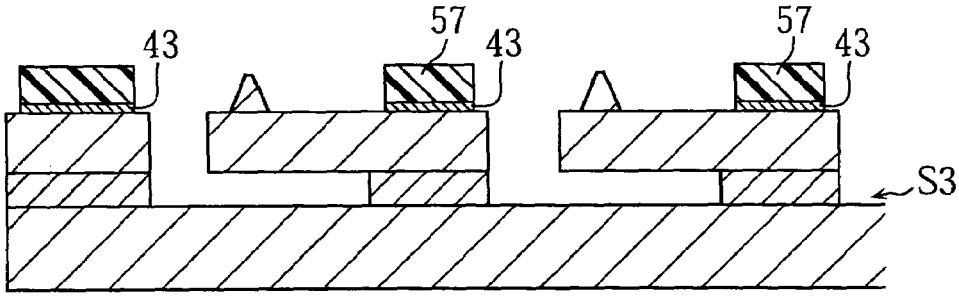
Figure 12L:
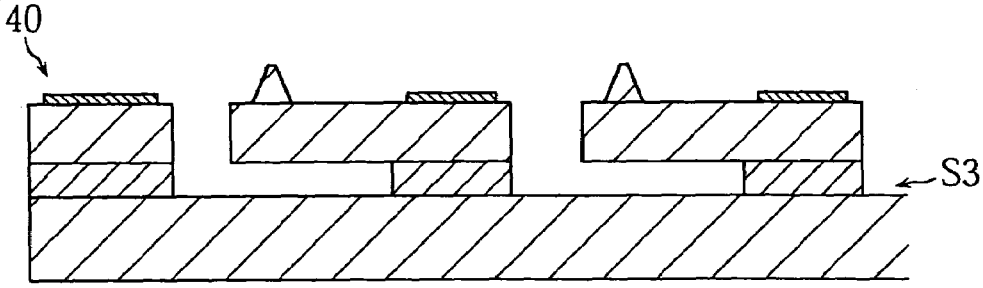

Then, as shown in FIG. 12I, a metal layer 56 is formed on the upper side (the projection-formed side) of the substrate S3 by vapor deposition, for example. For the material metal, use may be made of gold, copper or aluminum, each of which has a remarkably lower resistance than silicon. Then, as shown in FIG. 12J, a resist pattern 57 for making electrodes is formed on the frame portion 41*b* and the common fixing portions 41*c*. Then, with the resist pattern 57 used as the mask, wet etching is performed on the metal layer 56 to provide a conductive pattern or the electrode 43, as shown in FIG. 12K. The etchant should not unduly etch away the silicon material or any other material than the exposed portions of the metal layer 56. Finally, as shown in FIG. 12L, the resist pattern 57 is removed from the substrate S3, to provide the first contactor 40 of the contacting device X3.

Figure 13:
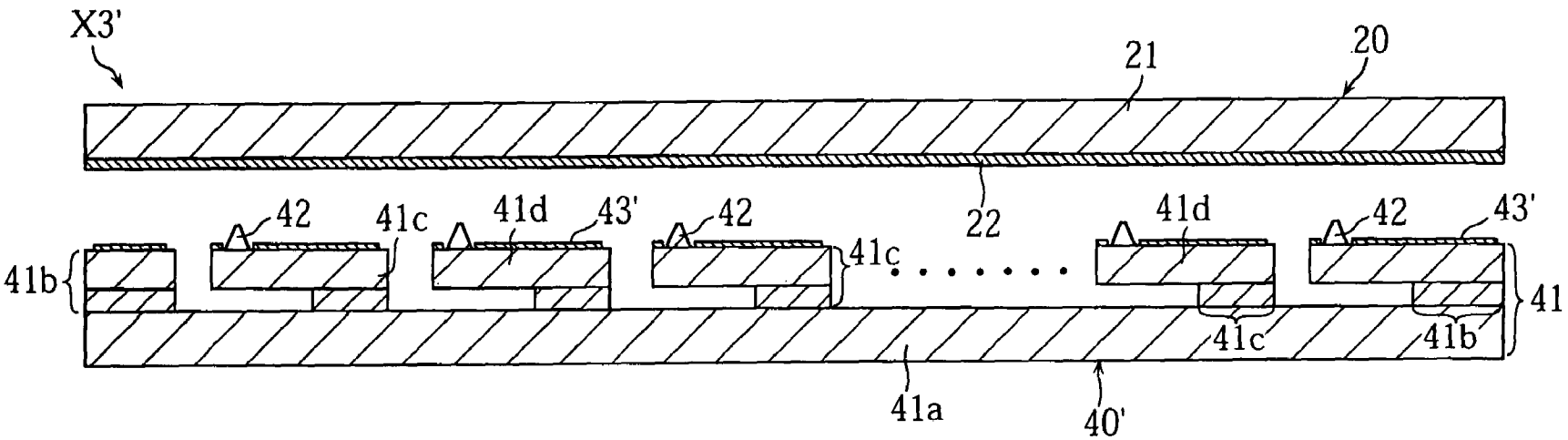
FIG. 13 is a sectional side view showing a modified version of the contacting device of FIG. 10.
Figure 14:
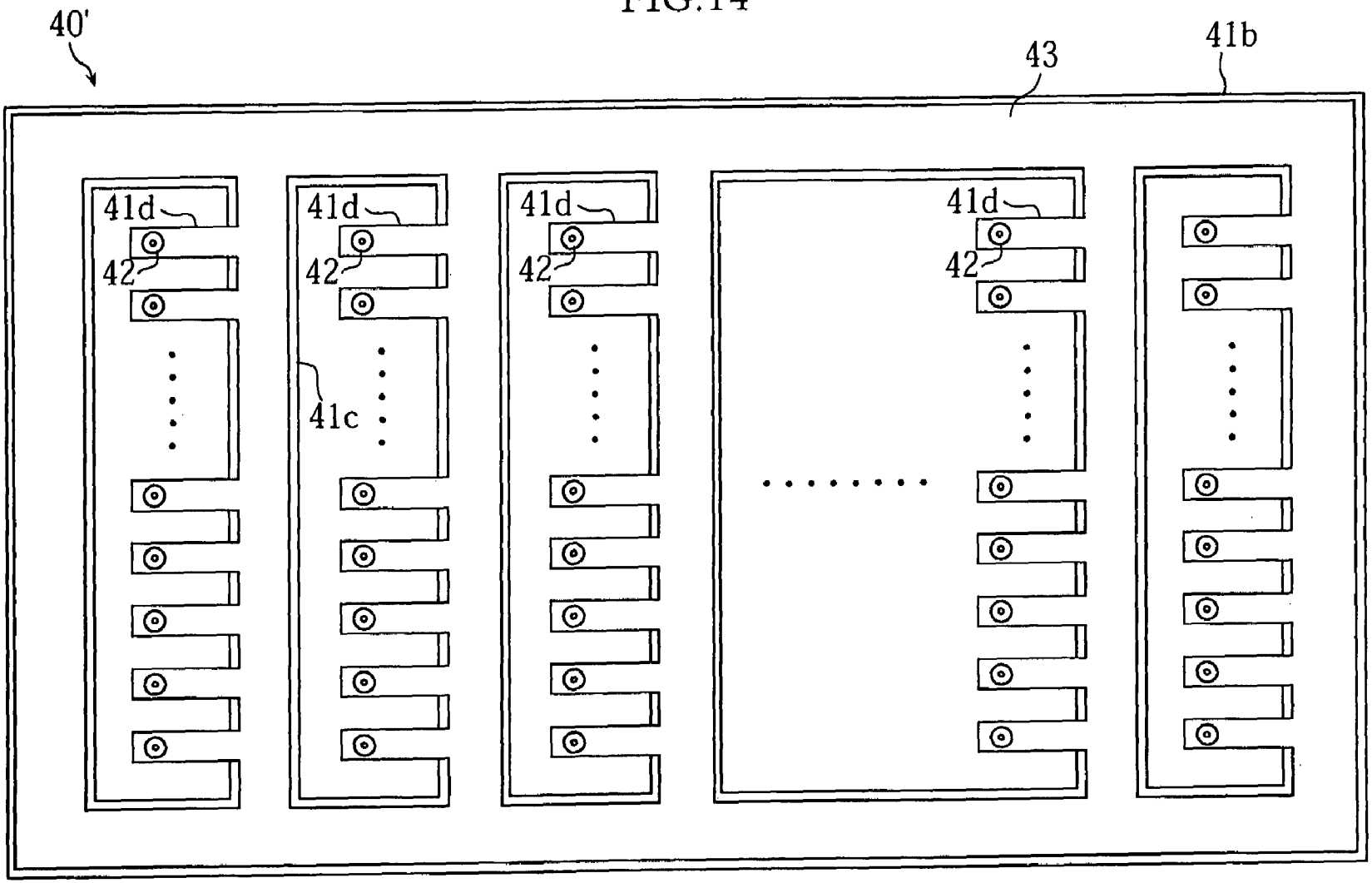
FIG. 14 is a plan view showing a first contactor of the contacting device of FIG. 13.

FIG. 13 is a partial sectional view showing an electrical contacting device X3', a modification of the contacting device X3 described above. The contacting device X3' includes a first contactor 40' and a second contactor 20. The first contactor 40' differs from the first contactor 40 of the unit X3 in that an electrode 43' has a different pattern from that of the electrode 43 shown in FIG. 11. As seen from FIG. 14, the electrode 43' is formed on the frame portion 41*b*, the common fixing portions 41*c* and further on the beams 41*d*. The other features of the first contactor 40' are the same as those of the first contactor 40 of the unit X3. Accordingly, the contacting device X3' functions in the same or substantially same manner as the contacting device X3.

In the contacting device X3', the resistors Rbi (see FIG. 1) have a shorter length than that in the contacting device X3. Specifically, the conductive material region (i.e., the resistor Rbi) that extends from the apex of each projection 42 to the electrode 43' is smaller in length than the conductive material region in the contacting device X3 that extends from the apex of the projection 42 to the electrode 43. Such an arrangement of the unit X3' is advantageous to making lower the resistance of the resistor Rbi.

FIG. 15 show a process of making the first contactor 40' of the contacting device X3'. The process is one example for making the first contactor 40' by micro-machining techniques. FIG. 15 are partial sectional views showing the first contactor 40' in the making.

Figure 15A:
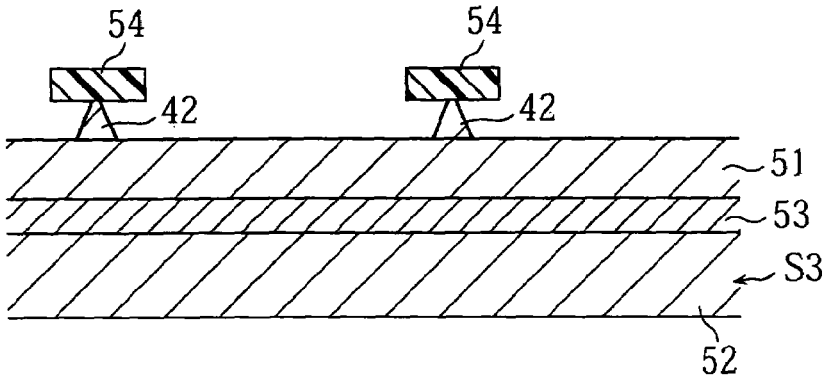
FIGS. 15A–15G illustrate the process of making the first contactor of the contacting device of FIG. 13.

To make the first contactor 40', first, a substrate S3 shown in FIG. 15A is prepared by the same steps as those described with reference to FIGS. 12A–12C. The substrate S3 of FIG. 15A has the same structure as that of the substrate S3 used for making the first contactor 40 of the contacting device X3. As seen from FIG. 15A, the illustrated substrate S3 is formed with a plurality of projections 43 upon which the resist pattern 54 is left unremoved.

Figure 15B:
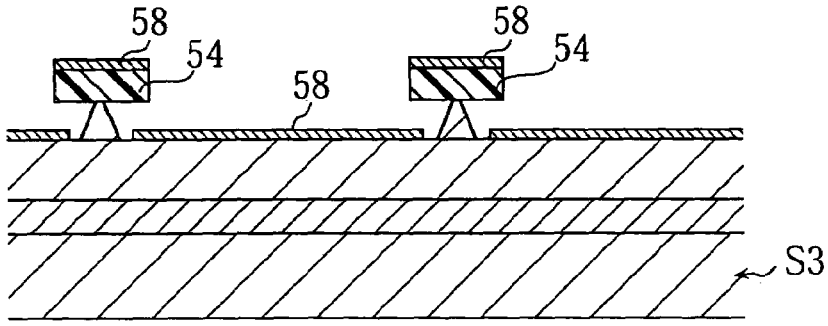
Figure 15C:
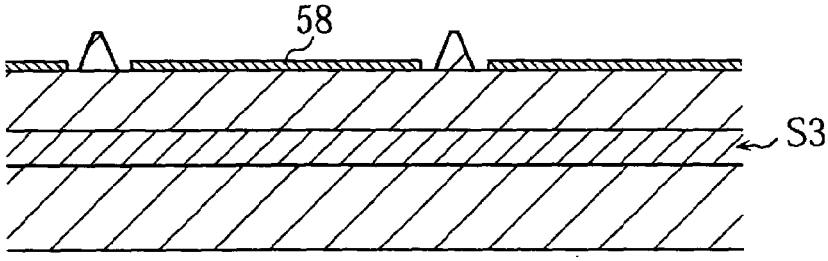
Figure 15D:
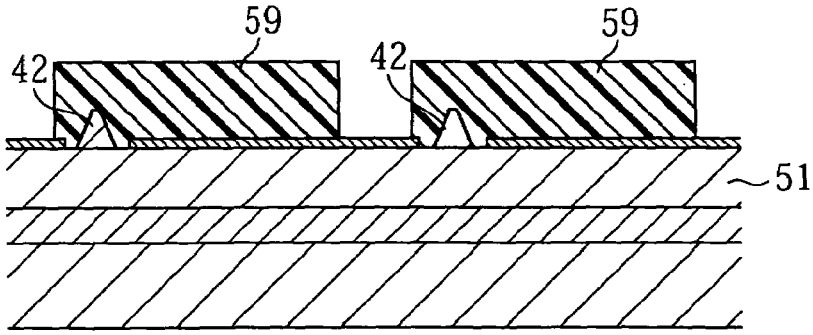

Then, as shown in FIG. 15B, a metal layer 58 is formed on the upper side (the projection-formed side) of the substrate S3 by vapor deposition, for example. The metal to be used may be gold, copper or aluminum, each of which has an appropriately lower resistance than silicon. Then, as shown in FIG. 15C, the resist pattern 54 is removed from the substrate S3. At this time, the metal layer 58 on the resist pattern 54 is also removed. Then, as shown in FIG. 15D, a resist pattern 59 is formed on the first layer 51. The resist pattern 59, covering the projections 42 and the metal layer 58, is laid to mask the portions to be processed into the frame portion 41*b*, the common fixing portions 41*c*, and the beams 41*d*.

Figure 15E:
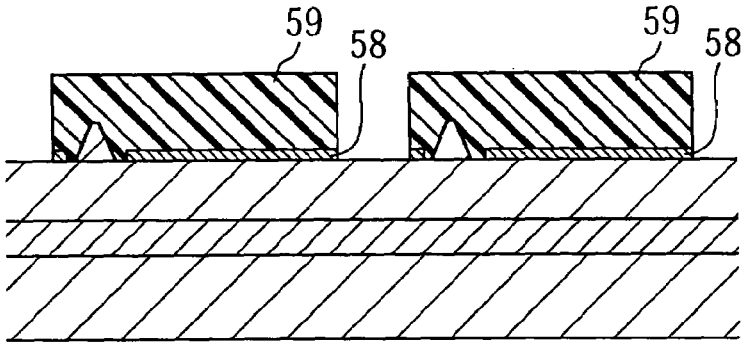
Figure 15F:
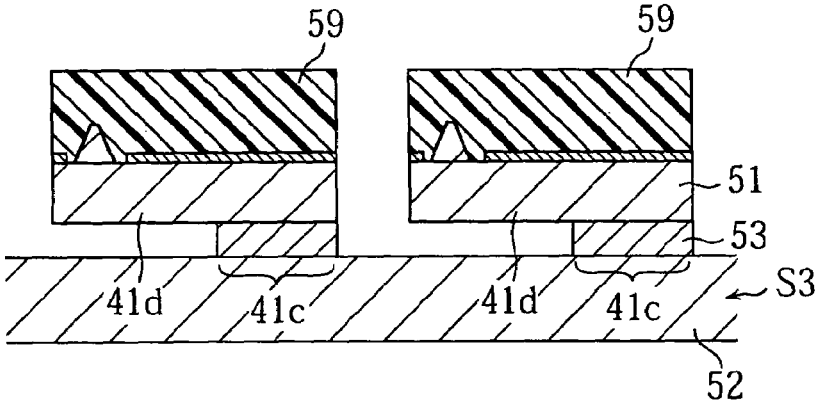
Figure 15G:
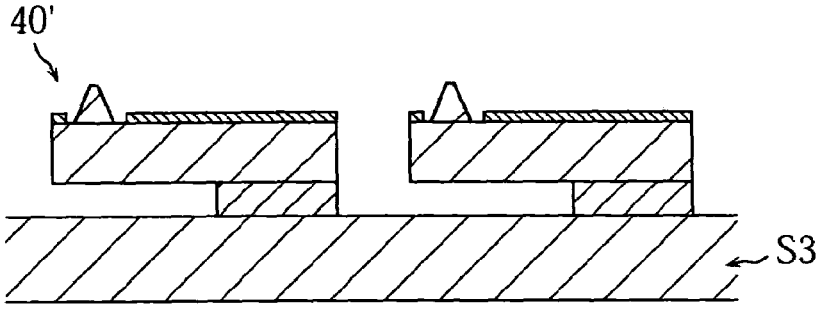

Then, as shown in FIG. 15E, wet etching is performed to remove the portions of the metal layer 58 that are not covered by the resist pattern 59. The etchant to be used should not unduly each away the silicon material or any other material than the exposed portions of the metal layer 58. Then, the substrate S3 is processed to have the configuration shown in FIG. 15F by the same steps as those described with reference to FIGS. 12F–12G. At the stage shown in FIG. 15F, the substrate S3 has the complete configuration required for the common fixing portions 41*c*, the beams 41*d*, and the frame portion 41*b*. Finally, as shown in FIG. 15G, the resist pattern 59 is removed from the substrate S3, to provide the first contactor 40' of the contacting device X3'.

Figure 16:
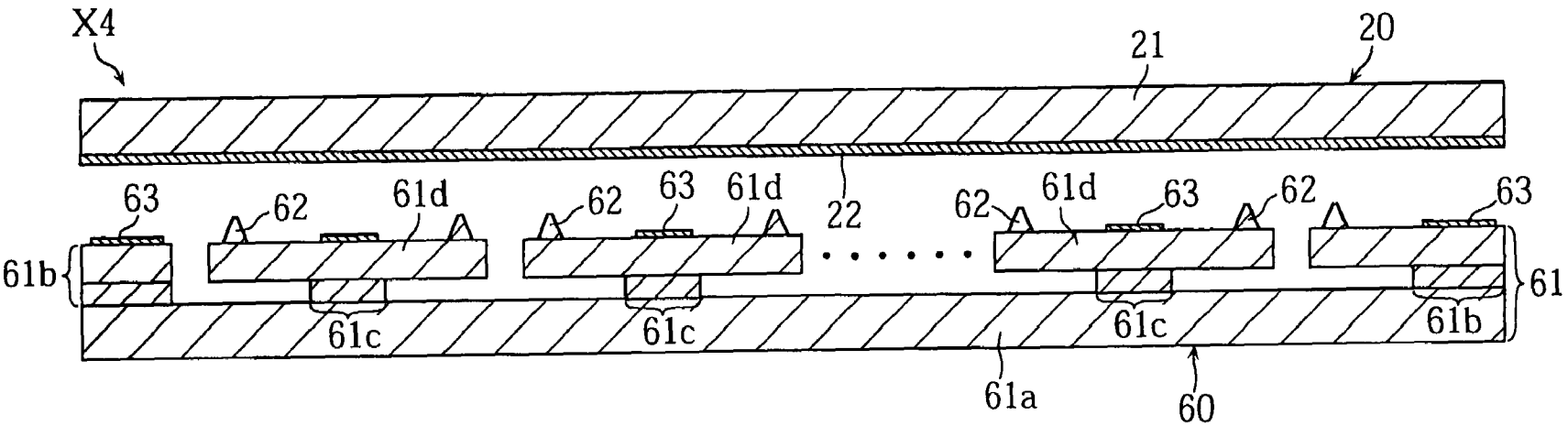
FIG. 16 is a sectional side view showing another type of contacting device according to the present invention.

FIG. 16 is a partial sectional view showing an electrical contacting device X4 according to a fourth embodiment of the present invention. The contacting device X4 includes a first contactor 60 and a second contactor 20. The first contactor 60 includes a base 61, a plurality of projections 62, and an electrode 63.

The base 61 includes a rear portion 61*a*, a frame portion 61*b*, a plurality of common fixing portions 61*c*, and a plurality of beams 61*d*. These elements, integral with each other, are formed of the same material by micro-machining techniques, as in the case of the rear portion 41*a*, the frame portion 41*b*, the common fixing portions 41*c* and the beams 41*d* of the third embodiment described above.

Figure 17:
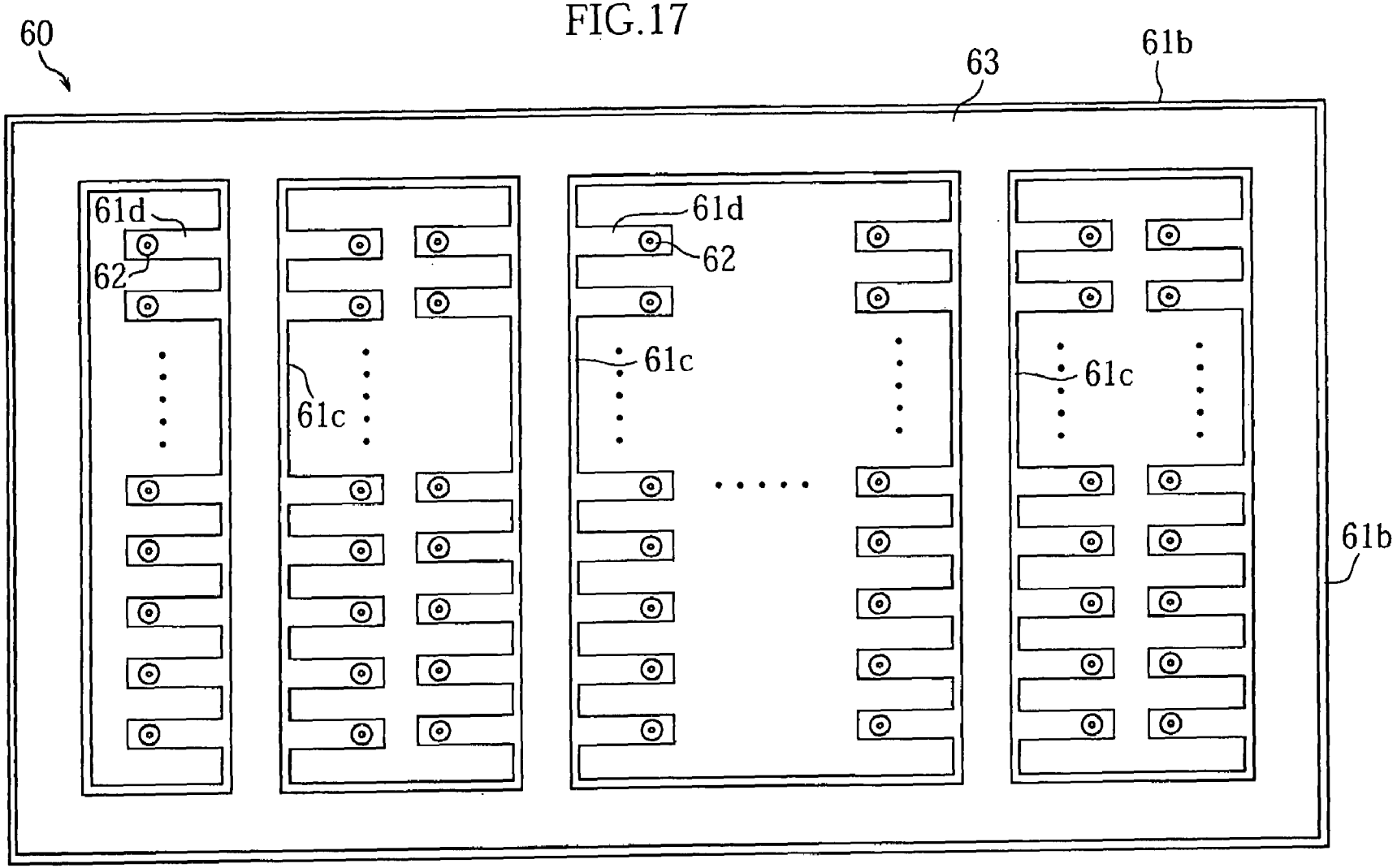
FIG. 17 is a plan view showing a first contactor of the contacting device of FIG. 16.

As shown in FIG. 17, the common fixing portions 61*c* are arranged in parallel with each other on the rear portion 61*a*. Each beam 61*d* extends laterally from a corresponding one of the common fixing portions 61*c*, so that it functions as a cantilever. In a region between two immediately adjacent common fixing portions 61*c*, a prescribed number of beams 41*d* extend in parallel from a first one of the adjacent fixing portions 41*c* toward the other (second fixing portion), and the same number of beams 41*d* extend in parallel from the second fixing portion to the first fixing portion.

Still referring to FIG. 17, the projections 62 are arranged in a two-dimensional array. In the illustrated example, each of the projections is generally a circular cone located on a corresponding one of the beams 61*d*. Electrical conductivity is given to an upper part of the fixing portions 61*c*, the beams 61, and the projections 62, all of which are formed of the same conductive material. The electrode 63, with the prescribed pattern, is formed on the frame portion 61*b* and the common fixing portions 61*c* and is made of a metal whose resistance is lower than the projections 62, the beams 61*d*, and the upper part of the fixing portions 61*c*. Instead of the pattern shown in FIG. 17, the electrode 63 may have a pattern similar to that of the above-described electrode 43', in which the electrode also extends onto the beams 61*d*. The surface of each projection 62 may be coated with a metal having a high melting point and a high boiling point. The conditions about the number and size of the projections 62 may be the same as those of the projections 12 of the first embodiment.

The first contactor 60 and the second contactor 20 are relatively movable to each other, so that they can selectively take a separate position shown in FIG. 16 and a contact position in which all the projections 62 are held in direct contact with the common electrode 22. In the illustrated example, the relative movement of the first and the second contactors 60, 20 is achieved by moving the first contactor 60 with respect to the second contactor 20 which is held stationary. Alternatively, the other relative driving modes as described with the first embodiment may be adopted. Driving means for the first contactor 60 may be the same as that described with the first embodiment.

In the contacting device X4 again, the circuit shown in FIG. 1 is built. Specifically, the apexes of the projections 62 of the first contactor 60 correspond to the first contacting points C1 in FIG. 1, while the portions of the common electrode 22 with which the projections 62 are held in engagement correspond to the second contacting points C2. The electrode 63 corresponds to the terminal E1. The silicon regions extending from the apexes of the projections 62 to the electrode 63 via the beams 61*d* correspond to the resistors Rbi (i=1,2, . . . , N). Electrically the common electrode 22 also corresponds to the terminal E2. The setting of the respective resistors Rbi and the setting of the number N of contacting points are made so that Inequalities (10) and (11) are satisfied.

In the switching operation, the contacting device X4, with the cantilever beams 61*d* supporting the contacting points (i.e., projections 62), functions in the same manner as the contacting device X3, thereby enjoying the same technical advantages as the unit X3.

In the contacting device X4, each common fixing portion 61 supports, on its both sides, two sets of beams 61*d* that extend oppositely from the fixing portion, each beam being provide with a projection 62. With this bilateral arrangement, the contacting device X4 is provided with a smaller number of fixing portions 61*c* than the contacting device X3, and yet the same number of projections 62 (contacting points) can be mounted. Thus, the contacting device X4 is more suitable for attaining high-density contacting points than the contacting device X3. Further, since the beams 61*d* are arranged symmetrically with respect to the common fixing portion 61*c*, generally symmetrical stress will act on the fixing portion 61*c* from its both sides when the contacting device X4 takes the contact position (ON position). This means that each fixing portion 61*c* of the unit X4 is prevented from suffering a lopsided load of stress. Accordingly, the fixing portions 61*c* are less prone to deteriorate with time, whereby the switching reliability of the contacting device X4 is maintained.

The first contactor 60 of the unit X4 may be made by the same steps as those described with reference to FIGS. 12A–12L for making the first contactor 40 of the contacting device X3. However, when the first contactor 60 has an electrode 63 extending onto the beams 61*d*, the contactor may be made by the same steps as those described with reference to FIGS. 15A–15G for making the first contactor 40' of the contacting device X3'.

Figure 18:
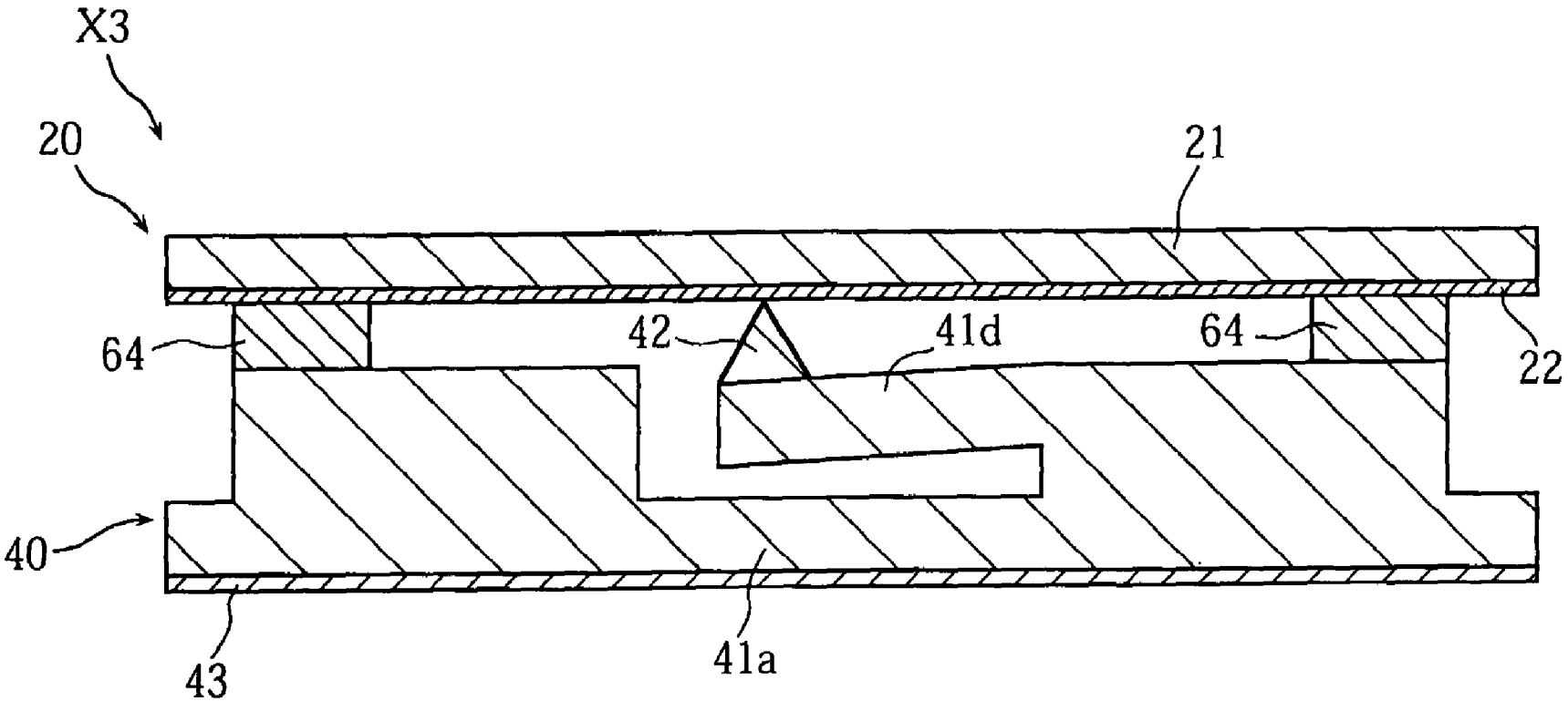
FIG. 18 is a sectional side view for illustrating the function of a stopper provided in a contacting device of the present invention.
Figure 19:
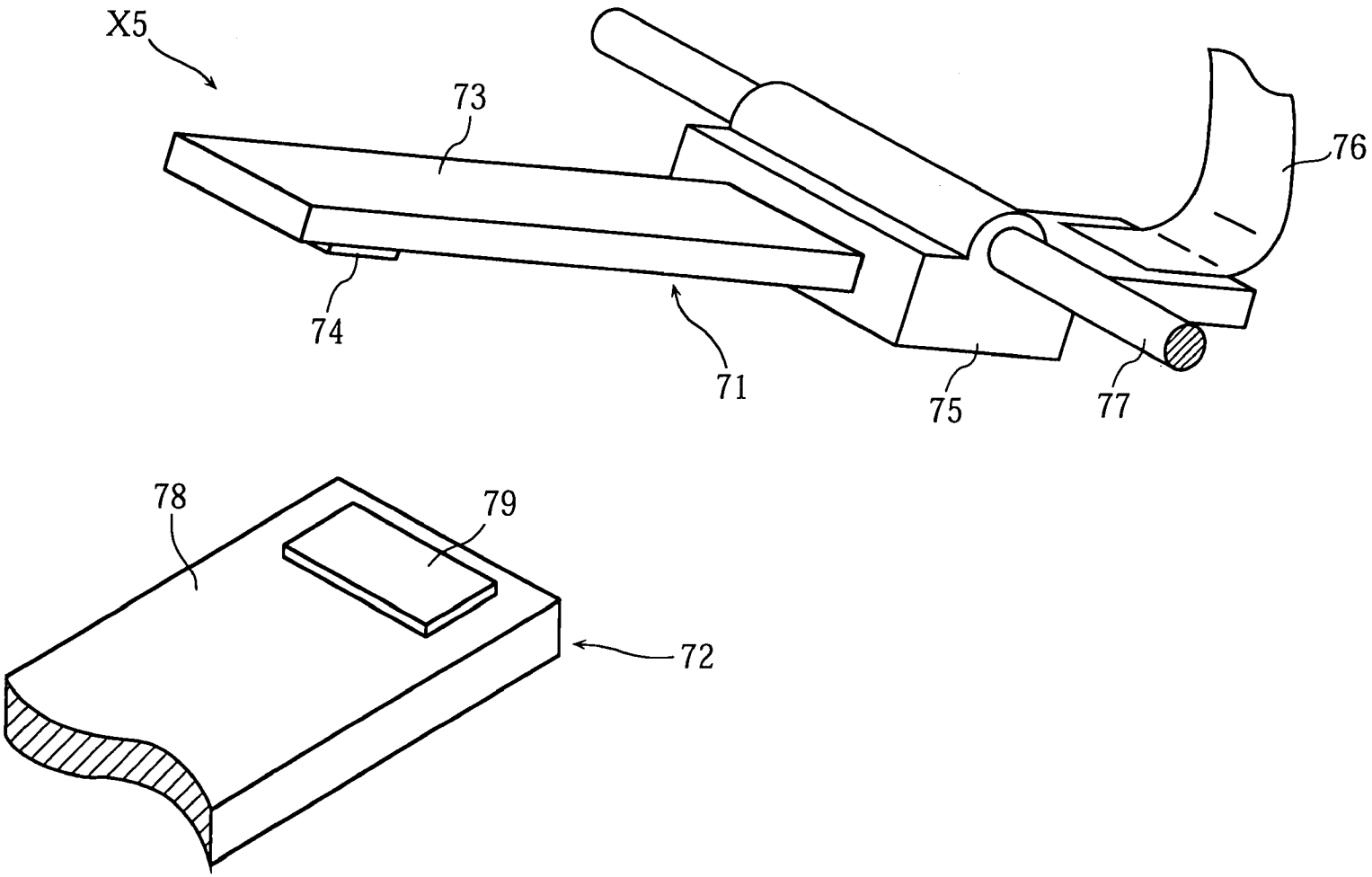
FIG.19 PRIOR ART
FIG. 19 is a perspective view showing a conventional contacting device in the open position.
Figure 20:
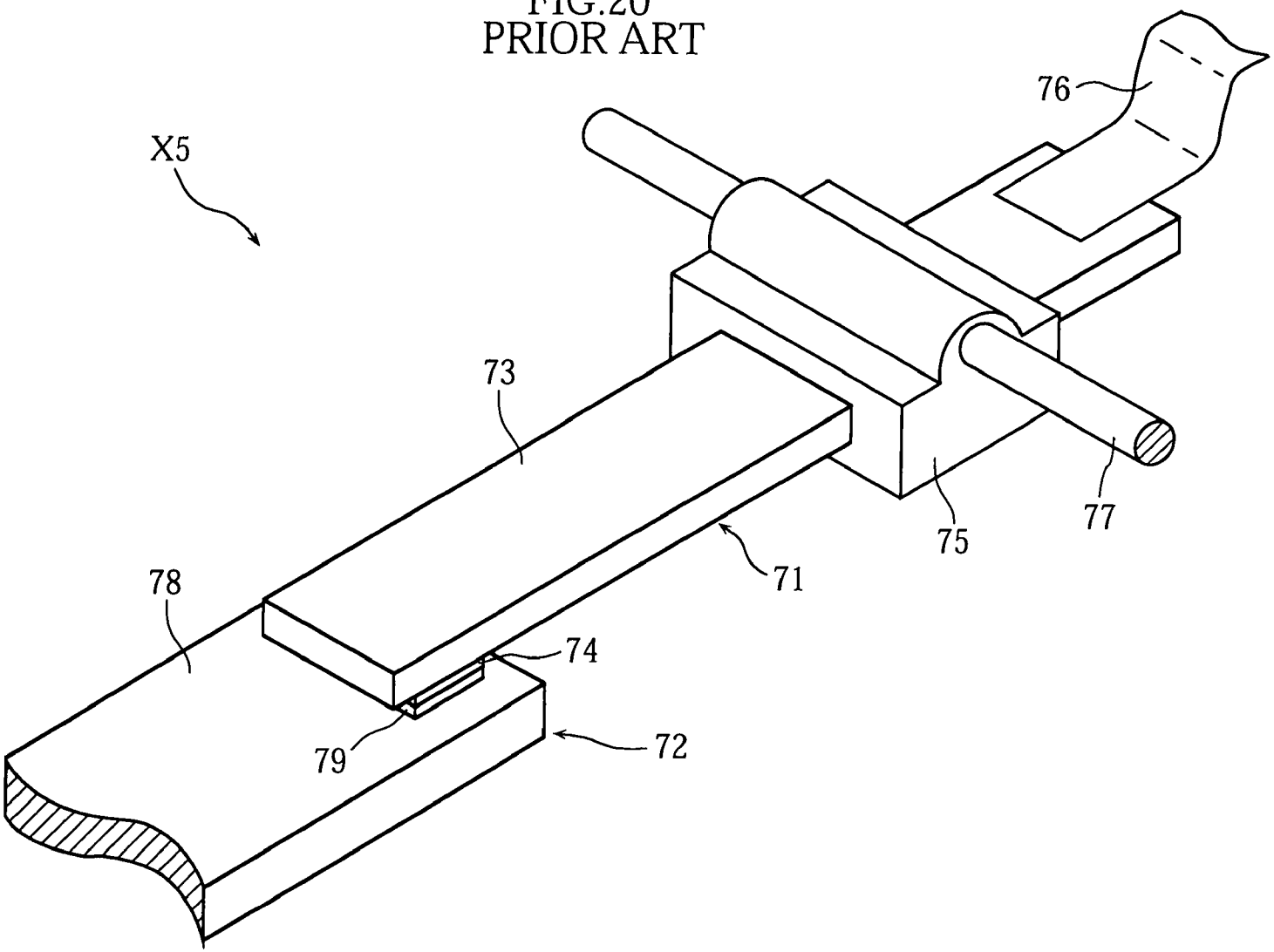
FIG.20 PRIOR ART
FIG. 20 is a perspective view showing the conventional device in the closed position.
Figure 21:
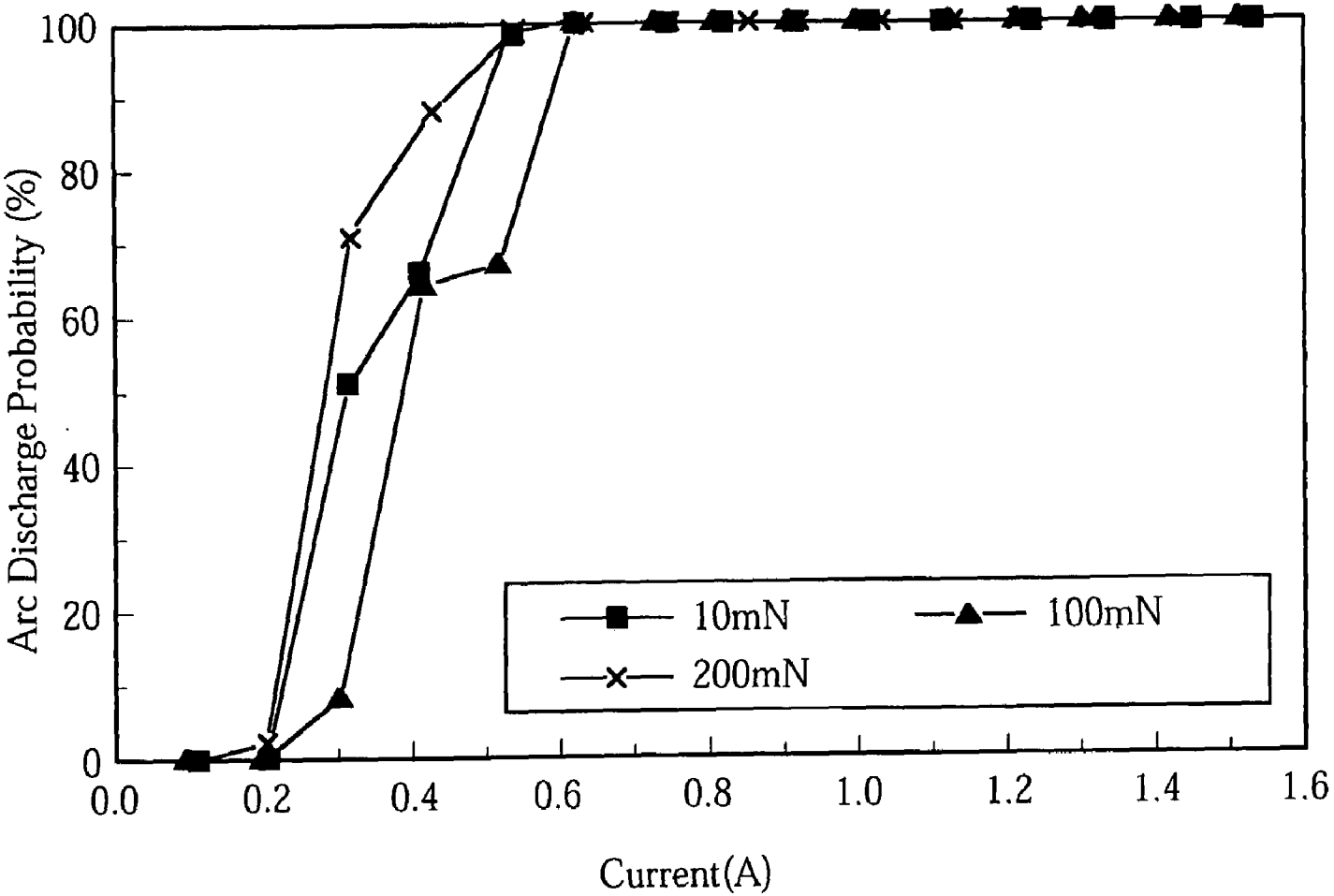
FIG. 21 is a graph for illustrating the dependency of the occurrence probability of arc discharge on the current flowing through paired contacts.
Figure 22:
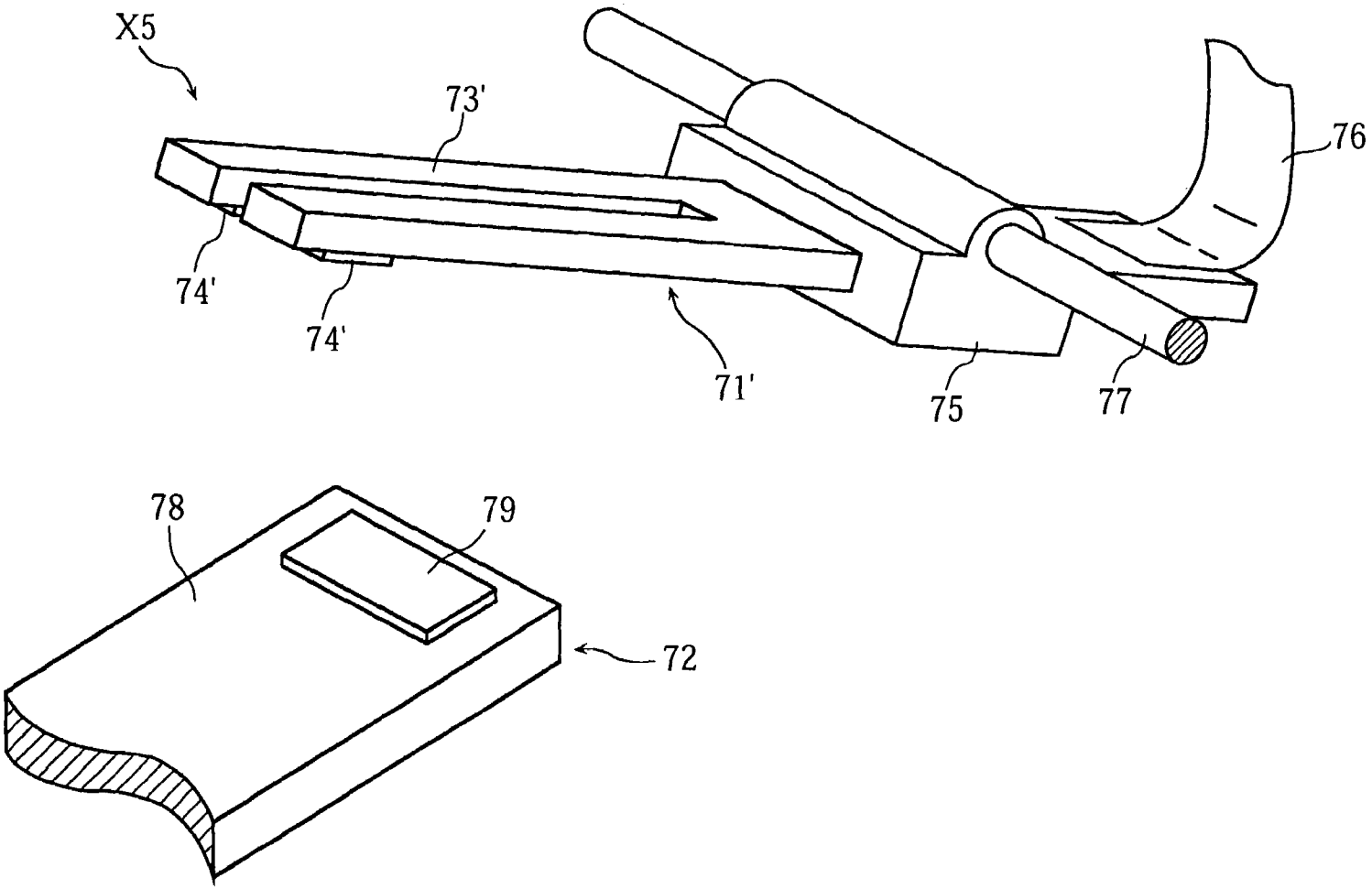
FIG.22 PRIOR ART
FIG. 22 is a perspective view showing another type of conventional contacting device with a twin contact structure.

According to the present invention, the above-described contacting devices X1–X4 and X3' may further include a stopper between the first and the second contactors for preventing the two contactors from coming too close. FIG. 18 schematically shows such a stopper provided on the contacting device X3 of the third embodiment.

In FIG. 18, the contacting device X3 is in the contact position, with a stopper 64 disposed between the first contactor 40 and the second contactor 20. The stopper 64 is formed of an insulating material and fixed to the first contactor 40. Alternatively, the stopper 64 may be fixed to the second contactor 20. The thickness of the stopper 64 is so adjusted that the projections 42 come into contact with the flat electrode 22 with an appropriate pressing force when the unit X3 takes the contact position. With the stopper 64 provided on the unit X3, it is possible to prevent the beams 41*d* from breaking under too much stress. As a result, the pressing force at the respective contacting points is equalized, whereby the switching characteristics is stabilized. Further, the stopper 64 prevents the beams 41*d* from coming into contact with the rear portion 41*a*. Since the stopper 64 is made of an insulating material, it ensures that the first contactor 40 and the second contactor 20 are electrically separated from each other.

Figure 3:
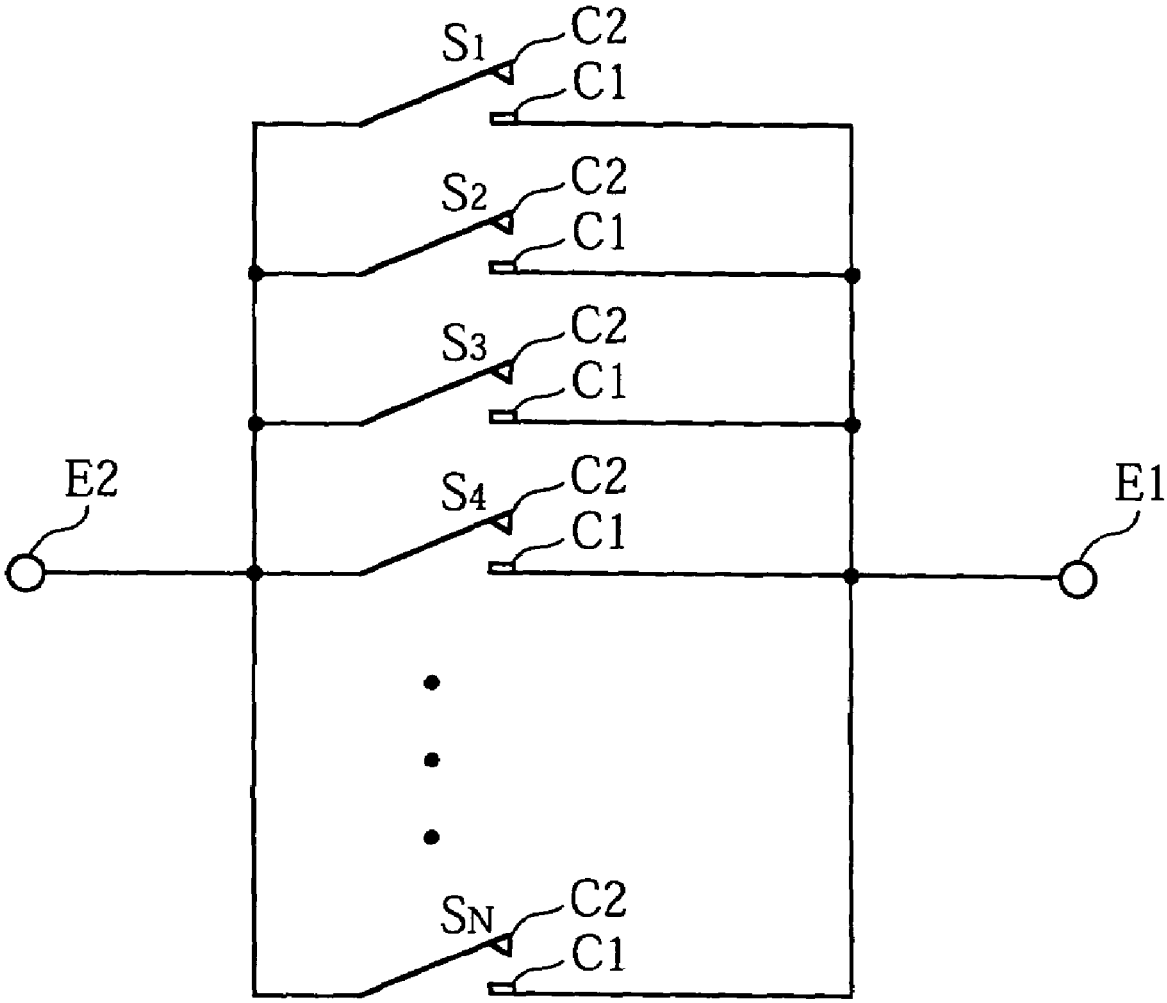
FIG. 3 is a circuit diagram of another electrical contacting device according to the present invention.
Figure 4:
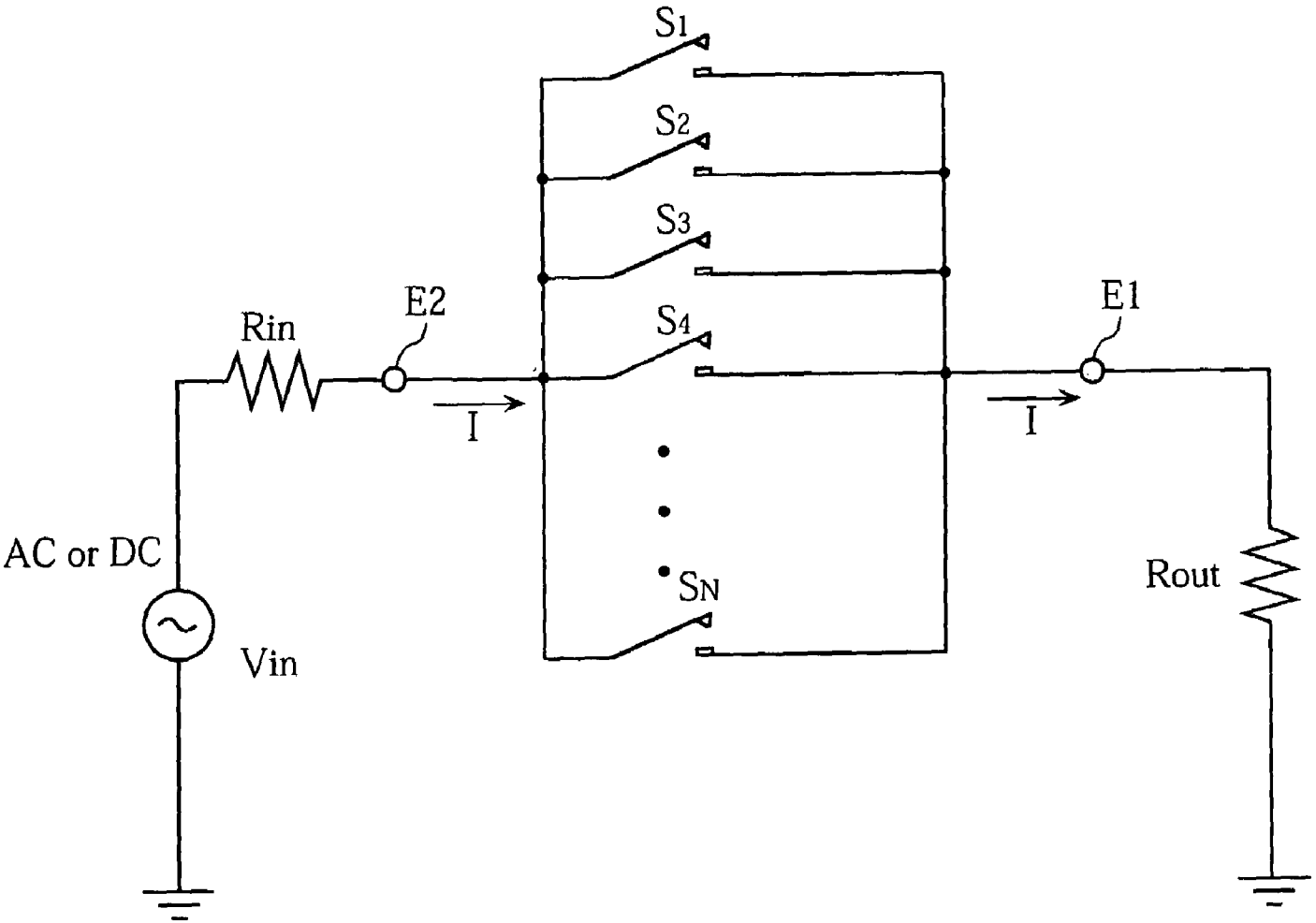
FIG. 4 is a circuit diagram schematically illustrating the actual situation in which the contacting device of FIG. 3 is used.

According to the present invention, a circuit shown in FIG. 3 may be built in the contacting devices X1–X4 and X3' in place of the circuit shown in FIG. 1. In this case, the silicon material that forms the base and the projections is doped with impurities so that the material becomes electrically conductive. In this manner, the resistor Rbi at each contacting point can have substantially zero resistance. Meanwhile, the first contacting points (i.e., the apexes of the respective projections) and the second contacting points (i.e., the common electrode 22 as a whole or only the portions thereof with which the projections come into contact) are made of a high-resistance metal, so that the contact resistance at the closed contacting points becomes high enough to prevent discharge current from occurring at the contacting points. With such an arrangement, the occurrence of arc discharge at the contacting points can be prevented completely or to a non-complete but practically appropriate extent. Accordingly, it is possible to reduce or eliminate the ablation and transformation of the material forming the contacting points, whereby the contacting device incorporating the circuit shown in FIG. 3 enables a highly reliable switching operation, and lasts a long life.

The present invention being thus described, it is obvious that the same may be varied in many ways. Such variations are not to be regarded as a departure from the spirit and scope of the present invention, and all such modifications as would be obvious to those skilled in the art are intended to be included within the scope of the following claims.

The invention claimed is:

1. An electrical contacting device comprising:

a plurality of current paths connected in parallel to each other;

a plurality of electrical contact points each having a first contact and a second contact that are mechanically opened and closed;

a plurality of resistors connected in series to the contact points, respectively;

a base having a first surface and a second surface opposite to the first surface;

a plurality of projections each disposed on the first surface of the base and having an apex; and a flat electrode which faces the first surface of the base and with which the projections come into contact, wherein each current path is provided with a corresponding one of the contact points, said each current path having electrical characteristics thereof adjusted to prevent arc discharge from occurring at the contact point, for each current path, the adjustment of the electrical characteristic is performed by rendering a resistance of the resistor greater than a contact resistance of the contact point, the first contacts correspond to the apexes of the projections, the second contacts correspond to portions of the flat electrode with which the apexes of the projections come into contact, and the resistors are built in the base and the projections.

2. The device according to claim 1, wherein the base and the projections are integrally formed of a same material substrate.

3. The device according to claim 1, further comprising a common electrode formed on the second surface of the base and connected to the resistors.

4. The device according to claim 1, wherein the base is provided with a plurality of flexible structures each of which is disposed at a corresponding one of the contact points for absorbing contact pressing force acting between the first contact and the second contact.

5. The device according to claim 4, wherein each flexible structure comprises a beam having ends thereof fixed and is provided with a corresponding one of the projections.

6. The device according to claim 4, wherein each flexible structure comprises a cantilever beam and is provided with a corresponding one of the projections.

7. The device according to claim 1, wherein a maximum voltage applied to the contacting device is Vmax and a minimum discharge current for each of the contact points is Imin, and wherein each of the resistors has a resistance greater than Vmax/Imin.

8. The device according to claim 1, wherein a maximum voltage applied to the contacting device is Vmax, a minimum discharge current for each of the contact points is Imin, and a total resistance of the contacting device is Rs, and wherein the number of the current paths is greater than Vmax/(Rs×Imin).

9. The device according to claim 1, wherein for each current path, the adjustment of the electrical characteristics is performed by adjusting a contact resistance of the contact point so that discharge current does not flow through said each current path.

10. The device according to claim 9, wherein a maximum voltage applied to the contacting device is Vmax and a minimum discharge current for each of the contact points is Imin, and wherein each of the contact points has a contact resistance greater than Vmax/Imin.

11. The device according to claim 1, wherein at least one of the first contact and the second contact is formed of one of a metal, oxide and nitride, each of these three substances containing a metallic element selected from a group of tantalum, tungsten, carbon and molybdenum.

12. The device according to claim 1, wherein at least one of the first contact and the second contact is formed of a material having a melting point no lower than 3000° C.

13. The device according to claim 1, further comprising a stopper for preventing the base and the flat electrode from approaching each other beyond an allowable minimum distance.

14. An electrical contacting device comprising:

a plurality of current paths connected in parallel to each other; and a plurality of electrical contact points each having a first contact and a second contact that are mechanically opened and closed, wherein each current path is provided with a corresponding one of the contact points, said each current path having electrical characteristics thereof adjusted to prevent arc discharge from occurring at the contact point, a maximum voltage applied to the contacting device is Vmax, a minimum discharge current for each of the contact points is Imin, and a total resistance of the contacting device is Rs, and the number of the current paths is greater than Vmax/(Rs×Imin).

* * * * *

UNITED STATES PATENT AND TRADEMARK OFFICE

CERTIFICATE OF CORRECTION

PATENT NO. : 7,053,739 B2
APPLICATION NO. : 10/725573
DATED : May 30, 2006
INVENTOR(S) : Noboru Wakatsuki et al.

It is certified that error appears in the above-identified patent and that said Letters Patent is hereby corrected as shown below:

Column 22:
Insert claim 15 as follows:

--15. The device according to claim 1, wherein the base and the projections are formed of a silicon material which is at least partially doped with impurities for providing the resistor in the base and the projections.--

Signed and Sealed this
Twenty-second Day of February, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,053,739 B2
APPLICATION NO. : 12/725573
DATED : May 30, 2006
INVENTOR(S) : Noboru Wakatsuki et al.

It is certified that error appears in the above-identified patent and that said Letters Patent is hereby corrected as shown below:

Delete the title page and substitute therefore the attached title page showing the corrected number of claims in patent.

Column 22, line 25:
Insert claim 15 as follows:

--15. The device according to claim 1, wherein the base and the projections are formed of a silicon material which is at least partially doped with impurities for providing the resistor in the base and the projections.--

This certificate supersedes the Certificate of Correction issued February 22, 2011.

Signed and Sealed this
Twenty-second Day of March, 2011

David J. Kappos

David J. Kappos
*Director of the United States Patent and Trademark Office*

(12) United States Patent
Wakatsuki et al.

(10) Patent No.: US 7,053,739 B2
(45) Date of Patent: May 30, 2006

(54) ELECTRICAL CONTACTING DEVICE AND METHOD OF MAKING THE SAME

(75) Inventors: Noboru Wakatsuki, Ishinomaki (JP); Yu Yonezawa, Miyagi (JP); Yoshio Satoh, Kawasaki (JP); Tadashi Nakatani, Kawasaki (JP); Tsutomu Miyashita, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 10/725,573

(22) Filed: Dec. 3, 2003

(65) Prior Publication Data

US 2004/0155737 A1 Aug. 12, 2004

(30) Foreign Application Priority Data

Dec. 18, 2002 (JP) ..... 2002-367325

(51) Int. Cl.
*H01H 9/30* (2006.01)

(52) U.S. Cl. ..... 335/201; 335/133; 335/156; 335/196; 200/10

(58) Field of Classification Search ..... 335/83, 335/133–135, 156, 196–200, 201; 200/10
See application file for complete search history.

(56) References Cited

U.S. PATENT DOCUMENTS 3,586,809 A * 6/1971 Santi ..... 200/263
2001/0024895 A1 * 9/2001 Sakiyama et al. ..... 439/181

FOREIGN PATENT DOCUMENTS

JP 5-054786 3/1993
JP 10-012117 1/1998

OTHER PUBLICATIONS

Yonezawa, Yu, et al., "Measurement of Electric Contact Phenomenon Using $LiNbO_3$ Piezoelectric Actuator", Jpn. J. Appl. Phys. vol. 41, pp. 4760-4765, Jul. 2002.

* cited by examiner

*Primary Examiner*—Ramon M. Barrera
(74) *Attorney, Agent, or Firm*—Staas & Halsey LLP

(57) ABSTRACT

An electrical contacting device includes a plurality of current paths connected in parallel to each other, and a plurality of electrical contact points each having a first contact and a second contact that are mechanically opened and closed. Each current path is provided with a corresponding one of the contact points. For prevention of the occurrence of arc discharge at the contact points, each current path has its electrical characteristics adjusted in order not to allow the passage of the minimum discharge current.

15 Claims, 24 Drawing Sheets

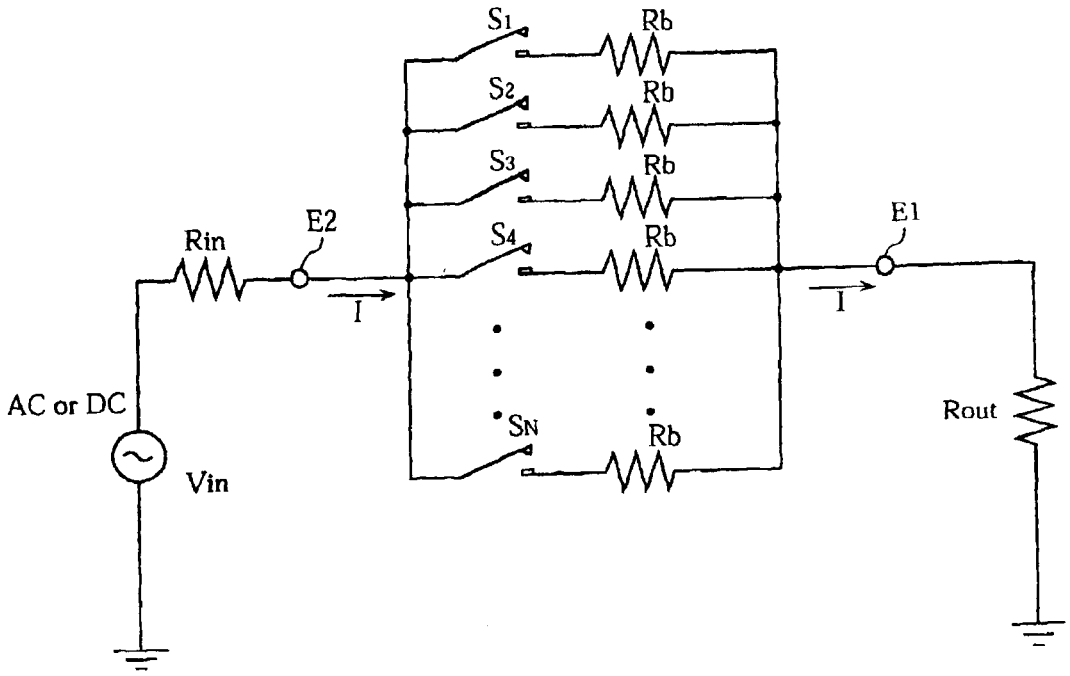

UNITED STATES PATENT AND TRADEMARK OFFICE

CERTIFICATE OF CORRECTION

PATENT NO. : 7,053,739 B2
APPLICATION NO. : 10/725573
DATED : May 30, 2006
INVENTOR(S) : Noboru Wakatsuki et al.

It is certified that error appears in the above-identified patent and that said Letters Patent is hereby corrected as shown below:

Delete the title page and substitute therefore the attached title page showing the corrected number of claims in patent.

Column 22, line 25:
Insert claim 15 as follows:

--15. The device according to claim 1, wherein the base and the projections are formed of a silicon material which is at least partially doped with impurities for providing the resistor in the base and the projections.--

This certificate supersedes the Certificates of Correction issued February 22, 2011 and March 22, 2011.

Signed and Sealed this
Seventh Day of February, 2012

David J. Kappos

David J. Kappos
*Director of the United States Patent and Trademark Office*

(12) United States Patent
Wakatsuki et al.

(10) Patent No.: US 7,053,739 B2
(45) Date of Patent: May 30, 2006

(54) ELECTRICAL CONTACTING DEVICE AND METHOD OF MAKING THE SAME

(75) Inventors: Noboru Wakatsuki, Ishinomaki (JP); Yu Yonezawa, Miyagi (JP); Yoshio Satoh, Kawasaki (JP); Tadashi Nakatani, Kawasaki (JP); Tsutomu Miyashita, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 10/725,573

(22) Filed: Dec. 3, 2003

(65) Prior Publication Data

US 2004/0155737 A1 Aug. 12, 2004

(30) Foreign Application Priority Data

Dec. 18, 2002 (JP) ..... 2002-367325

(51) Int. Cl.
*H01H 9/30* (2006.01)

(52) U.S. Cl. ..... 335/201; 335/133; 335/156; 335/196; 200/10

(58) Field of Classification Search ..... 335/83, 335/133–135, 156, 196–200, 201; 200/10
See application file for complete search history.

(56) References Cited

U.S. PATENT DOCUMENTS 3,586,809 A * 6/1971 Santi ..... 200/263
2001/0024895 A1* 9/2001 Sakiyama et al ..... 439/181

FOREIGN PATENT DOCUMENTS

JP 5-054786 3/1993
JP 10-012117 1/1998

OTHER PUBLICATIONS

Yonezawa, Yu, et al., "Measurement of Electric Contact Phenomenon Using $LiNbO_3$ Piezoelectric Actuator", Jpn. J Appl. Phys. vol. 41, pp. 4760-4765, Jul. 2002.

* cited by examiner

*Primary Examiner*—Ramon M. Barrera
(74) *Attorney, Agent, or Firm*—Staas & Halsey LLP

(57) ABSTRACT

An electrical contacting device includes a plurality of current paths connected in parallel to each other, and a plurality of electrical contact points each having a first contact and a second contact that are mechanically opened and closed. Each current path is provided with a corresponding one of the contact points. For prevention of the occurrence of arc discharge at the contact points, each current path has its electrical characteristics adjusted in order not to allow the passage of the minimum discharge current.

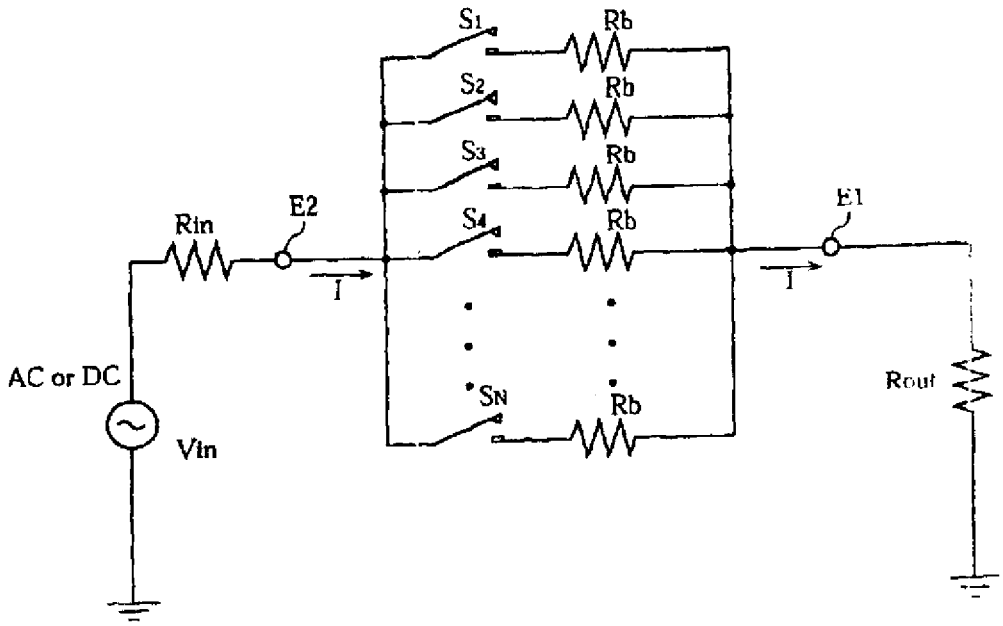

15 Claims, 24 Drawing Sheets